US009349333B2

(12) United States Patent
Ooga

(10) Patent No.: US 9,349,333 B2
(45) Date of Patent: May 24, 2016

(54) CONTROL CIRCUIT AND DISPLAY DEVICE EQUIPPED WITH THE SAME

(71) Applicant: NLT Technologies, Ltd., Kanagawa (JP)

(72) Inventor: Kouichi Ooga, Kanagawa (JP)

(73) Assignee: NLT TECHNOLOGIES, LTD., Kanagawa (JP)

( * ) Notice: Subject to any disclaimer, the term of this patent is extended or adjusted under 35 U.S.C. 154(b) by 0 days.

(21) Appl. No.: 14/508,159

(22) Filed: Oct. 7, 2014

(65) Prior Publication Data

US 2015/0097880 A1 Apr. 9, 2015

(30) Foreign Application Priority Data

Oct. 9, 2013 (JP) ..... 2013-211866

(51) Int. Cl.
*G09G 3/34* (2006.01)
*G09G 3/36* (2006.01)

(52) U.S. Cl.
CPC ..... *G09G 3/3611* (2013.01); *G09G 3/3406* (2013.01); *G09G 2320/0233* (2013.01); *G09G 2320/0646* (2013.01); *G09G 2330/021* (2013.01); *G09G 2340/06* (2013.01); *G09G 2360/16* (2013.01)

(58) Field of Classification Search
CPC ..... G09G 2320/0233; G09G 2340/06; G09G 3/3406; G09G 3/3611; G09G 2320/0646; G09G 2360/16; G09G 2330/021
See application file for complete search history.

(56) References Cited

U.S. PATENT DOCUMENTS

2007/0279372 A1* 12/2007 Brown Elliott ..... G09G 3/3426 345/102
2008/0180384 A1* 7/2008 Aoki ..... G02F 1/133514 345/102
2009/0085847 A1* 4/2009 Morisue ..... G09G 3/3406 345/88
2009/0160747 A1* 6/2009 Morisue ..... G09G 3/3406 345/88
2009/0262148 A1* 10/2009 Kimura ..... G09G 3/2003 345/690
2009/0315921 A1* 12/2009 Sakaigawa ..... G09G 3/2003 345/694

(Continued)

FOREIGN PATENT DOCUMENTS

JP 2007-010753 1/2007
JP 2009-086054 4/2009

(Continued)

*Primary Examiner* — Dwayne Bost
*Assistant Examiner* — Christopher Kohlman
(74) *Attorney, Agent, or Firm* — Young & Thompson

(57) ABSTRACT

A control circuit conducts a drive control of a RGBW display panel to operate white pixels to light up together with red, green and blue pixels, where the drive control includes a luminance control of a backlight to reduce luminance of the backlight according to an amount of an increase in luminance of the display panel due to a lighting operation of the white pixels. The control circuit includes: a first circuit section configured to generate control signals for controlling the display panel; and a second circuit section configured to generate control signals for controlling the backlight. The first circuit section includes a redistributing circuit section configured to distribute a luminance component of each white pixel to corresponding the red, green and blue pixels and reduce luminance of the each white pixel when the display panel has a white chromaticity dependence on gradation values.

11 Claims, 13 Drawing Sheets

(56) References Cited

U.S. PATENT DOCUMENTS

2010/0259556 A1* 10/2010 Inuzuka ..... G09G 3/3611 345/604
2011/0148908 A1* 6/2011 Jeong ..... G09G 5/02 345/590
2012/0249610 A1* 10/2012 Katagami ..... G09G 3/3426 345/690
2014/0015865 A1* 1/2014 Kim ..... G09G 5/10 345/690

FOREIGN PATENT DOCUMENTS

JP 2010-049011 3/2010
JP 2012-027405 2/2012

* cited by examiner

CONTROL CIRCUIT AND DISPLAY DEVICE EQUIPPED WITH THE SAME

TECHNICAL FIELD

The present invention relates to a control circuit and a display device equipped with the same, and especially relates to a control circuit which controls drive of a display panel having dependence of white chromaticity on gradation values and to a display device equipped with the control circuit.

BACKGROUND

Regarding electricity consumption of slim display devices, various efforts to reduce electricity consumption of a backlight, such as a use of LEDs (Light Emitting Diodes) in a backlight (hereinafter, also referred to as B/L), have been made in recent years. However, the ratio of electricity consumption of a backlight to the total electricity consumption of a display device is now still great. In view of that, a reduction of the electricity consumption by using a technology to control the luminance of a backlight according to image signals, is now being made. Further, there has been proposed another technology to furthermore reduce electricity consumption of a backlight. That is, a technology of a RGBW display device which employs W (white) pixels in addition to R (Red), G (Green) and B (Blue) pixels so as to enhance the luminance, is combined with a technology to control the luminance of a backlight. The extent of enhanced luminance in the RGBW display device is used for reducing the luminance of the backlight, so as to furthermore reduce the electricity consumption of the backlight.

For example, Japanese Unexamined Patent Application Publication (JP-A) No. 2007-10753 discloses one of such technologies to reduce the electricity consumption of a backlight. That is, the disclosed technology uses an image data conversion circuit illustrated in FIG. 12 to drive a backlight, where the drive process includes a control of luminance of the backlight. In the drive process, a gradation conversion is applied onto image data so as to make the maximum value of data assigned to each color pixels the same as each other, without maximizing the value of data assigned to white pixels. Thereby, the gradation-extension rate given after the gradation conversion is increased.

In concrete terms, image data inputted to the image data conversion circuit is first converted into RGBW data. In the image data conversion circuit, there are a four-color conversion circuit A for converting RGB data into RGBW data without chromatic and luminance changes, and a four-color conversion circuit B for converting RGB data into RGBW data with chromatic and luminance changes. The input image data is inputted to both the conversion circuits. On the basis of a level detection signal, either one of the RGBW data respectively outputted from the four-color conversion circuits A and B is selected by a selector. That is, if the data is regarded as that of the white peak region, the signal from the conversion circuit B is selected, and if the data is equal to or lower than normal 100% white, the signal from the conversion circuit A is selected. The RGBW data outputted from the selector is temporarily retained in a memory for a certain retention period. On the other hand, a maximum data value register retains the maximum values of the respective color data outputted during the retention period. After display data corresponding to one screen is retained in the memory, and the maximum data value for each color within the screen is set in the maximum data value register, a backlight luminance control circuit calculates the backlight light-emission quantity on the basis of the maximum data value for each color, and controls the light emission quantity of the backlight at the time of displaying the next screen. On the other hand, a backlight luminance compensation data conversion circuit sequentially reads display data in the memory, and after performing data conversion on the basis of the backlight light-emission quantity signal inputted from the backlight luminance control circuit so as to compensate for the backlight luminance, outputs the resultant data as the display data for the next screen.

Further, JP-A No. 2012-27405 discloses a technology to correct color shift of W pixels caused in a RGBW display device. Since there are provided no color filters for W pixels, W pixels cannot transmit light having selected wavelengths, which can cause a shift of the peak of the spectrum of the white light coming from the W pixels toward a short wavelength direction, depending on the gradation value. Therefore, the color tone of the white created by the W pixels can be different from that of white created by R, G and B pixels. In view of that, the disclosed technology employs an output signal generating section illustrated in FIG. 13, and conducts color conversion processing with the section after processing of RGBW signals, to correct the color shift of the W pixels by using all of the RGBW pixels.

The output signal generating section includes a backlight level calculating section, an LCD level calculating section, a chromaticity point adjusting section, and an RGB/RGBW converting section. The output signal generating section carries out a predetermined signal processing based on a video signal D1 (D1*r*, D1*g*, and D1*b*). By this, a lighting signal BL1 which shows luminance level (lighting level) in the backlight, and a video signal D4 (pixel signal D4*r* for R, pixel signal D4*g* for G and pixel signal D4*b* for B, and pixel signal D4*w* for W) or an output video signal are generated.

Further, JP-A No. 2009-086054 discloses the technology to lower the luminance of pixels by applying luminance lowering processing or chroma lowering processing onto signals of pixels each having a high gradation value, in a RGBW display device illustrated in FIG. 14, in order to increase the effect of the reduction of electricity consumption. This document shows the following formulas as a way to calculate the W value, and discloses that the effect of the reduction of electricity is increased by increasing the value to be distributed to the W sub-pixels.

$$W=\max(R,G,B)/2,\ \text{for}\ \max(R,G,B)/2\geq\min(R,G,B)$$

$$W=\min(R,G,B),\ \text{for}\ \max(R,G,B)/2<\min(R,G,B)$$

The document further discloses that, in order to further provide the effect of the reduction of electricity consumption, luminance lowering processing and chroma lowering processing are also applied onto signals of pixels each having high gradation value, to reduce the electricity consumed by the backlight.

The RGBW display device illustrated in FIG. 14 includes a liquid crystal panel containing pixels each divided into four sub-pixels, a red (R), a green (G), a blue (B), and a white (W) sub-pixel, and a white backlight which emits light with controllable emission luminance. The RGBW display device further includes a luminance lowering section, an output signal generating section, a liquid crystal panel control section and a backlight control section. The luminance lowering section performs luminance lowering processing on high luminance pixel data of pixel data contained in input RGB signals representing an input image to transform the input RGB signals to luminance-lowered RGB signal. The output signal generating section generates transmittance signals for individual R, G, B, W sub-pixels in the pixels in the liquid crystal panel from the luminance-lowered RGB signals and also calculates a backlight value for the white backlight from the luminance-lowered RGB signals. The liquid crystal panel control section outputs panel control signals and controls driving of the liquid crystal panel according to the transmittance signals generated in the output signal generating section. The backlight control section outputs backlight control signals and controls the emission luminance of the backlight according to the backlight value calculated in the output signal generating section.

JP-A No. 2010-049011 discloses the following technology. In order to increase a reduction of electricity consumption of a RGBW display device illustrated in FIG. 15, the display device conducts luminance lowering processing and chroma lowering processing for signals of pixels each having a high gradation value, to lower the luminance of pixels. In this case, applying the luminance lowering processing and the chroma lowering processing onto signals of the pixels simply, can results in the situation that some pixels originally having different gradation values have the same resulting gradation value, which can causes white saturation (flattened gradation). In view of that, the display device conducts gradation correction by using a LUT (lookup table) before conducting the luminance lowering processing and the chroma lowering processing, and creates a conversion table so as to prevent the resulting data for pixels originally having different gradation values from having the same value, which avoids the flattening of gradation. The RGBW display device includes a liquid crystal panel containing pixels each divided into four sub-pixels, a red (R), a green (G), a blue (B), and a white (W) sub-pixel, and a white backlight which emits light with controllable emission luminance. The RGBW display device further includes a gradation correcting section, a chroma and luminance lowering section, a γ correction section, an output signal generating section, a liquid crystal panel control section and a backlight control section. The gradation correcting section reduces the signal value of an input RGB signal and converts the value into a gradation-corrected RGB signal. The chroma and luminance lowering section lowers the chroma and luminance of the gradation-corrected RGB signal and converts the gradation-corrected RGB signal into a chroma-and-luminance-lowered RGB signal. The γ correction section applies γ correction to the chroma-and-luminance-lowered RGB signal and converts it into a γ-corrected RGB signal. The output signal generating section generates a transmittance signal of a sub-pixel of each of R, G, B and W in each pixel of the liquid crystal panel from the γ-corrected RGB signal, and calculates a backlight value. The liquid crystal panel control section outputs a panel control signal and controls driving of the liquid crystal panel according to the transmittance signal generated in the output signal generating section. The backlight control section outputs a backlight control signal and controls the emission luminance of the backlight according to the backlight value calculated in the output signal generating section.

As described above, the realization of the luminance reduction of a backlight also needs a luminance control using a gradation conversion. However, in some display panels, because of their characteristics, the luminance control using the gradation conversion can cause a sense of strangeness about quality of a displayed image, for example, a conspicuous change in color tone of an area displayed in white due to the luminance control using a gradation conversion, which is a problem. It means that it is important to provide a control circuit for reducing the electricity consumption of a backlight with minimizing the sense of strangeness about the image quality.

Hereinafter, the change in color tone of the area displayed in white, coming from a gradation conversion, will be considered. For the consideration, there are provided an instance that an 8 bit-input display device displays a solid-color screen (rastered screen) in which the solid color has a gradation value of 255, namely, an all-white screen; and another instance that the 8 bit-input display device displays a window in red (R) having a gradation value of 255, as a primary color, in the above solid-color screen. In these instances, the maximum gradation value of the display device is assumed to be 255.

In the former instance that the display device displays the all-white screen, since there are no high-chroma pixels in the screen, all the W pixels over the screen are operated to light up fully (where the gradation value is 255). When the ratio of the luminance component of white created by a W pixel to the luminance component of white created by corresponding R, G and B pixels is 1 to 1, the total luminance of all the R, G, B and W pixels becomes twice as the luminance of R, G and B pixels. It enables the luminance of the backlight to be reduced to 50% of the base luminance, where the luminance of white color created by the R, G and B pixels in the RGBW display panel is used as the base luminance in the instances.

On the other hand, in the latter instance that the display device displays a window in red as primary color having the gradation value of 255 (R=255, G=0, B=0) in the all-white screen, since the red primary color of the gradation value of 255 is the highest in chroma all over the screen, the luminance of the backlight is hardly reduced in total. In the white area of the screen, the lighting level of each pixel can be defined individually. Therefore, the lighting level of each W pixel in the white area is set to be maximum, and the total luminance of the pixels in the white area becomes twice as the base luminance, which needs such excessively-high luminance of the pixels in the white area (R=255, G=255, B=255, W=255) to be reduced by 50%. By reducing the gradation value from 255 to 186, the luminance of the pixels in the white area can be reduced by 50%. Accordingly, applying a gradation conversion to R=186, G=186, B=186, W=186 onto the pixels results in the luminance reduced by 50%.

If a display panel having a characteristic that the chromaticity value when the display panel displays white of the gradation value of 186 is different from that when the display panel displays white of the gradation value of 255, is used in this instance, users can perceive a chromaticity difference of the displayed white color, which occurs due to a gradation conversion, and it results in a sense of strangeness about image quality. Concretely, in a instance that the display panel has a gradation-chromaticity characteristic that, as the gradation value changes from 255 to a smaller value, the chromaticity value represented by x, y coordinates of a xy chromaticity diagram changes to a smaller value, the displayed white color becomes bluish white as the gradation value decreases. In other words, the color of the white area, which has been displayed in pure white, changes to bluish white due to the red window displayed in the white screen, which causes a sense of strangeness about quality of the displayed image.

The present invention seeks to solve the problem.

SUMMARY

In view of the above problem, there are provided illustrative control circuits and display devices each equipped with the control circuit, as embodiments of the present invention, so that the illustrative control circuits and display devices can reduce electricity consumption of a backlight with the sense of strangeness of image quality being minimized, on conducting a control of a RGBW display device including a control of luminance of a backlight.

A control circuit illustrating one aspect of the present invention is a control circuit which conducts a drive control of a RGBW display panel to operate white pixels to light up together with red pixels, green pixels and blue pixels, where the drive control includes a luminance control of a backlight to reduce luminance of the backlight according to an amount of an increase in luminance of the RGBW display panel due to a lighting operation of the white pixels. The control circuit comprises: a first circuit section configured to generate control signals to be used for controlling the RGBW display panel, based on input image signals; and a second circuit section configured to generate control signals to be used for controlling the backlight, based on the input image signals. The first circuit section includes a redistributing circuit section. The redistributing circuit section is configured to conduct luminance-redistribution processing under a condition that the RGBW display panel has a characteristic that a chromaticity of white displayed thereon depends on gradation values, where the luminance-redistribution processing includes distributing a luminance component of each of the white pixels to corresponding the red, green and blue pixels and reducing luminance of the each of the white pixels.

A display device illustrating one aspect of the present invention is a display device comprising: a backlight; and a RGBW display panel having a characteristic that a chromaticity of white displayed thereon depends on gradation values. The RGBW display panel comprises a plurality of unit pixels each including red, green blue and white pixels. The display device further comprises the above-described control circuit configured to conduct a drive control of the RGBW display panel to operate the white pixels to light up together with the red pixels, green pixels and blue pixels. The drive control includes a luminance control of the backlight to reduce luminance of the backlight according to an amount of an increase in luminance of the RGBW display panel due to a lighting operation of the white pixels.

Other features of illustrative embodiments will be described below.

BRIEF DESCRIPTION OF THE DRAWINGS

Embodiments will now be described, by way of example only, with reference to the accompanying drawings which are meant to be exemplary, not limiting, and wherein like elements numbered alike in several figures, in which.

DETAILED DESCRIPTION

Figure 1:
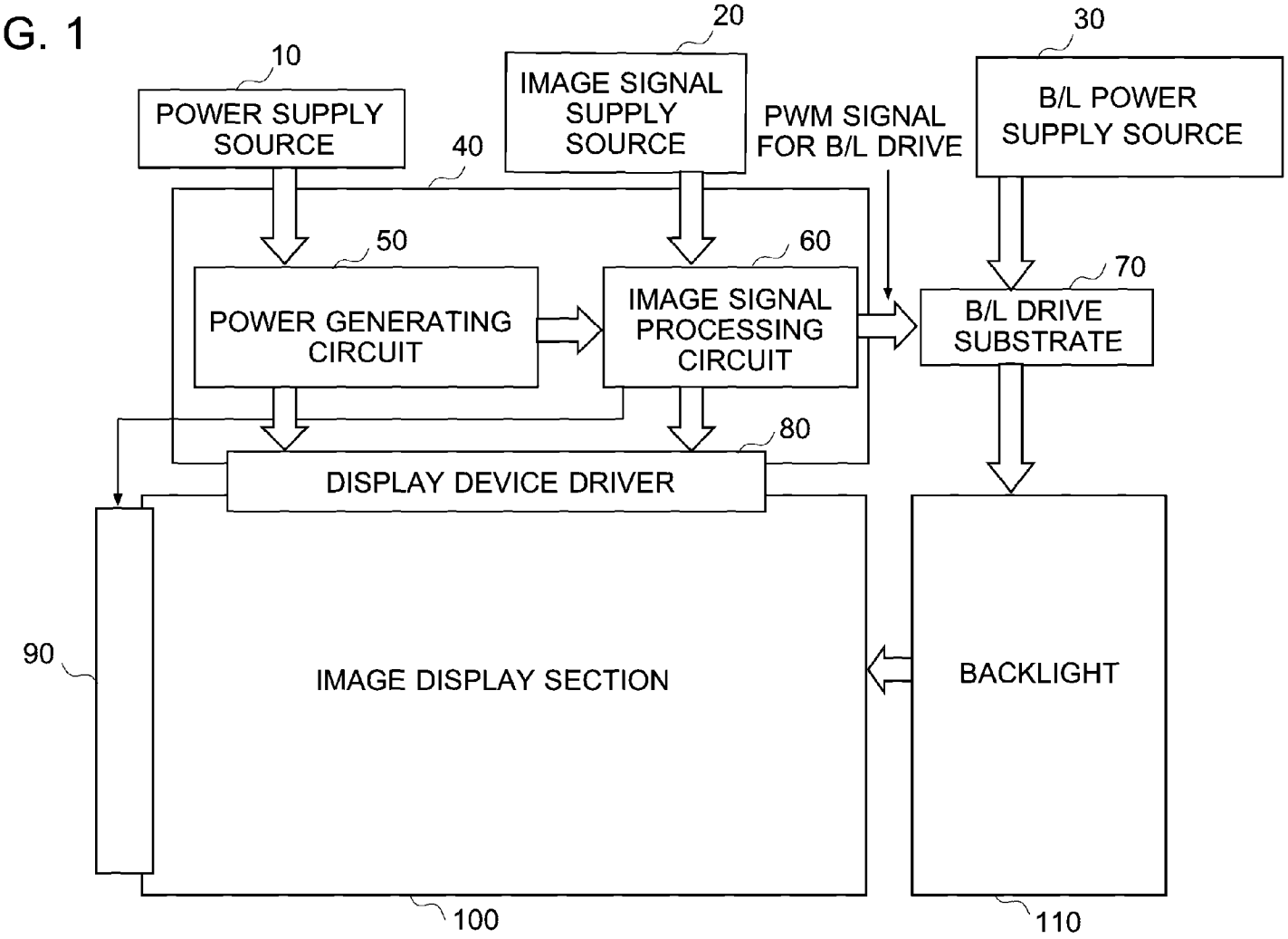
FIG. 1 is a block diagram illustrating the overall structure of a display device relating to the present embodiment.

Illustrative embodiments of control circuits and display devices each equipped with the control circuit will be described below with reference to the drawings. It will be appreciated by those of ordinary skill in the art that the description given herein with respect to those figures is for exemplary purposes only and is not intended in any way to limit the scope of potential embodiments may be resolved by referring to the appended claims.

With the illustrative embodiments, electricity consumption of an RGBW display device can be reduced as follows. In the RGBW display device, there is provided a W value redistribution circuit section which redistributes a luminance component of each W pixel to corresponding R, G and B pixels. Thereby, even under the condition that drive of the RGBW display device, which includes a control of luminance of a backlight, is conducted with using a display panel having a dependence of which chromaticity on gradation values, the RGBW display device can realize a control of luminance of the backlight thereof to reduce the electricity consumption thereof, while minimizing a sense of strangeness about image quality, such as a conspicuous change of the chromaticity of an area to be displayed in white because of a display image including a small primary-color area in addition to the area to be displayed in white.

Further, the illustrative embodiments do not employ a color conversion technology which calculates a luminance value and a gradation value of each of R, G, B and W colors for adjusting color tone and to adjust the chromaticity. Such a color conversion technology needs a conversion table (LUT or memory) for converting colors or numerical formulas for converting colors. However, a use of a LUT or memory enlarges a circuit structure, and a use of numerical formulas also enlarges a circuit structure because the use of the numerical formulas in a color conversion needs complicated calculations. Such enlargement of the structure of the circuit for reducing the sense of strangeness about image quality, increases the electricity consumption by the degree of the enlargement. In the illustrative embodiments, color tone is adjusted by using a simple calculation, which can reduce the circuit structure in size and can achieves a reduction of electricity consumption of the display device.

As described in descriptions about the background art, there is known a technology to reduce electricity consumption of a backlight in a display device which works with the backlight lighting up all during its working period, like a liquid crystal display device. In the technology, the luminance of the backlight is controlled according to inputted image signals. There is further known a technology that the above technology is applied to a RGBW liquid crystal display panel having four-color pixels, which are R, G and B pixels and W pixels. In these descriptions, a RGBW display device (display panel) means a display device (display panel) designed to enhance the luminance by employing a W pixel additionally to R, G and B pixels for each unit pixel.

Regarding a way to calculate W-pixel signals, there are known a way to receive RGB signals and replace the W component coming from the R, G and B pixels with the component of each W pixel, and a way to operate W pixels to light up at a level equal to the level of the luminance of the W component coming from the R, G and B pixels to complement the chroma. In these calculations, operating the W pixels to light up simply results in an image which has increased luminance but is whitish in color. Therefore, such calculations need a chroma compensation to prevent an occurrence of the sense of strangeness about image quality.

As a theory of operations for reducing electricity consumption of a backlight by linking drive of the display panel with the control of the backlight together, there is cited a way to operate W pixels to light up at the luminance level equivalent to the luminance component of white which can be created by R, G, B pixels, to conduct a chroma complement if it is necessary, and to reduce the luminance level of the backlight by the extent of luminance increased because of the lighting operation of the W pixels. For example, in a case that an input image has chroma which is low all over the image (that is, an image wherein the ratio of R, G and B values are same as each other, such as a white, black image and grayscale colors), since the lighting level of the W pixels becomes great, the lighting level of the backlight is lowered. In another case that the input image has high chroma (that is, an image including a primary color such as R, G and B), since the lighting level of the W pixels becomes small (that is, the W pixels do not light up for primary colors), the lighting level of the backlight is not lowered. In other words, in a case that the input image signals have low chroma, the reduction of the luminance of the backlight becomes great, whereby a reduction of electricity consumption of the display device can be expected.

On the other hand, since the lighting level of a W pixel in each unit pixel can be made different individually in the RGBW liquid crystal display device, the pixel including a W pixel lighting at the minimum lighting level in one frame of image signals is used as the reference pixel to be used for the reduction of the luminance of the backlight. To maintain the original image quality, the reduction amount of the luminance of the backlight is defined based on the reference pixel in which a W pixel lights up at the minimum lighting level.

Naturally, defining the pixel in which a W pixel lights up at the minimum lighting level as the reference pixel, means that a W pixel in each of the other unit pixels lights up at the lighting level being greater than the minimum lighting level. Under this situation, there can be unit pixels which light up at an excessively high level in comparison with the original image, which also causes a sense of strangeness of image quality. Therefore, it is necessary to make the increase amount of the lighting level of those pixels the same as the increase amount of the lighting level of the pixel at the minimum lighting level among the W pixels in one frame. That is, as for the pixels lighting up at the excessively high level, the luminance needs to be reduced for each of the pixels. The luminance of each pixel can be reduced by lowering the gradation value of each pixel.

Those are the theory of the operations to lower the luminance of the backlight according to an image signal handled in an RGBW liquid crystal display device. According to such operations, an effect about reduced electricity consumption can be obtained by reducing the electricity used in the backlight. In the operations, the excessively-bright pixels are controlled to be reduced in their gradation values, in order to lower the luminance. However, in some display panels, because of their characteristics, a gradation change can make a change of color tones. In such display panels, when the excessively bright pixels is reduced in gradation value so as to reduce their luminance, the luminance of each pixel is lowered but the color tone of each pixel is changed, which also causes a sense of strangeness about image quality.

In view of that, one of the embodiments employs the following way to reduce the luminance of pixels, in order to prevent an occurrence of a sense of strangeness about image quality even when a display device employs a display panel in which color tones of pixels can be changed corresponding to a change in gradation values of the corresponding pixels. That is, as the way to reduce the luminance of the excessively bright pixels, one of the embodiments employs a way to reduce the luminance of each pixel with giving priority to chromaticity and luminance of R, G and B pixels, rather than to reduce the luminance of each of R, G, B and W pixels by the same level. The embodiment, with this way to reduce the luminance, can reduce the luminance of the backlight with minimizing the above-described sense of strangeness about image quality and can realize a reduction of an electricity consumption of the backlight.

EXAMPLES

Example 1

Figure 2:
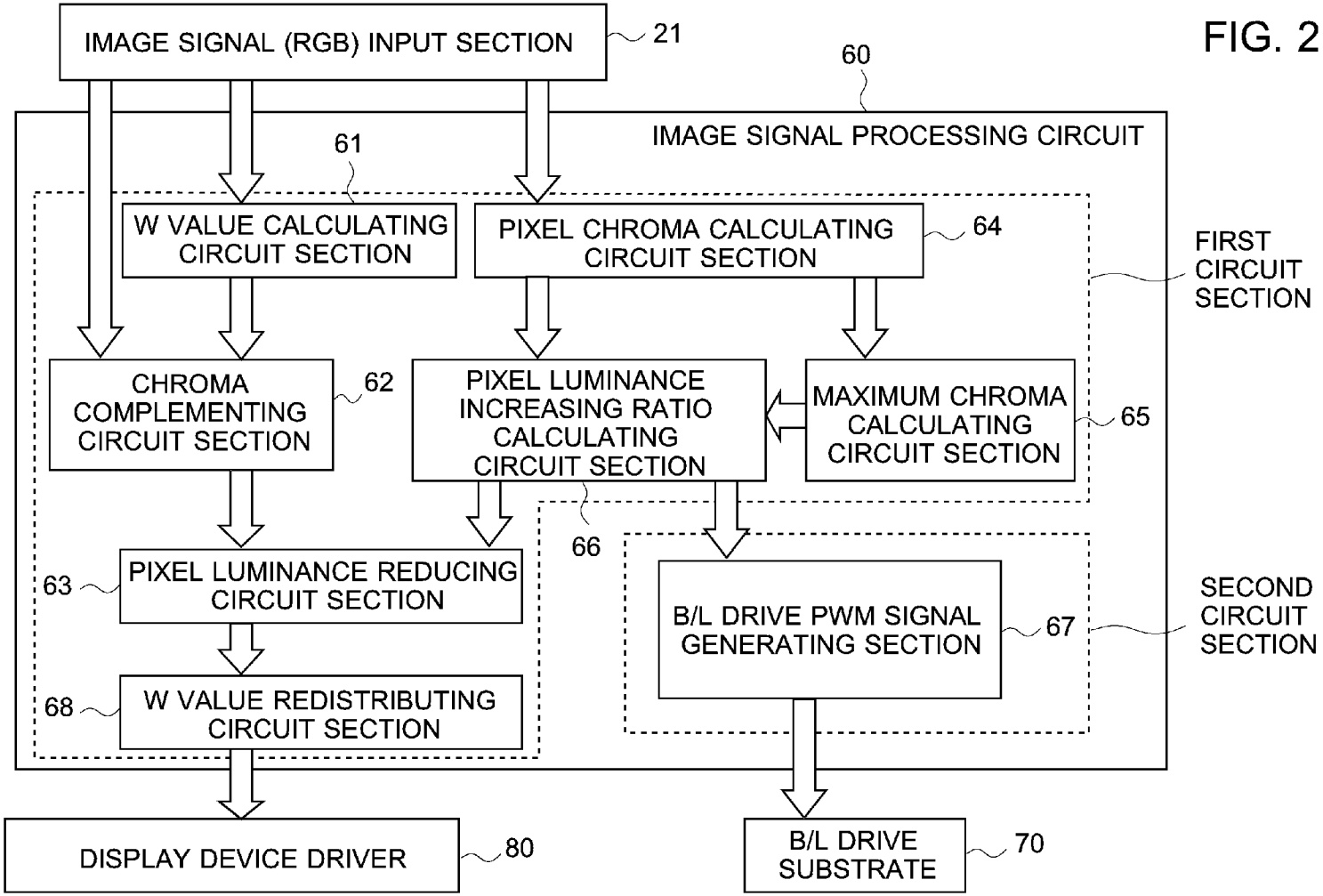
FIG. 2 is a block diagram illustrating a structural example of an image signal processing circuit relating to Example 1.
Figure 3:
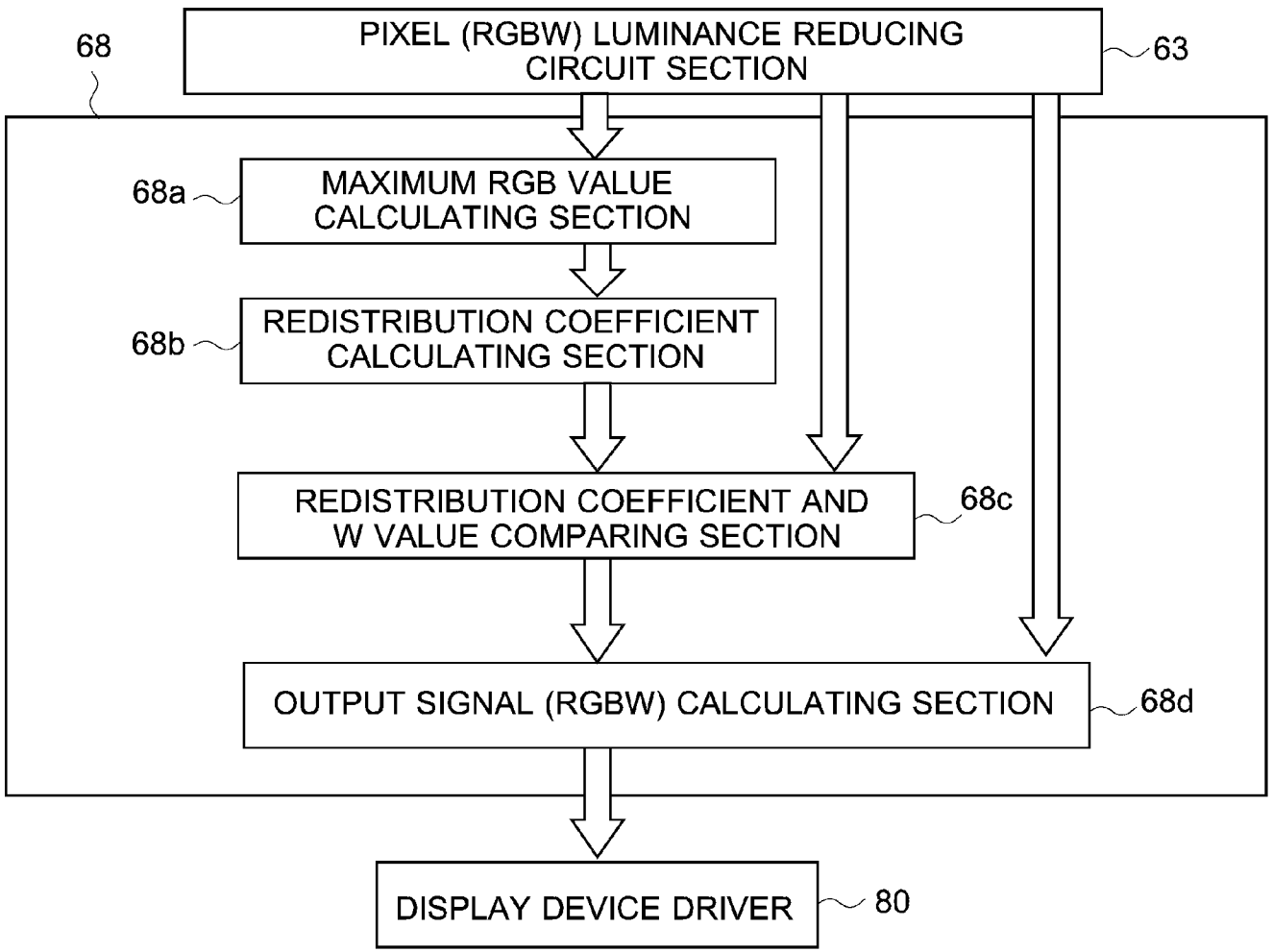
FIG. 3 is a block diagram illustrating a structural example of a W value redistributing circuit section relating to Example 1.
Figure 4:
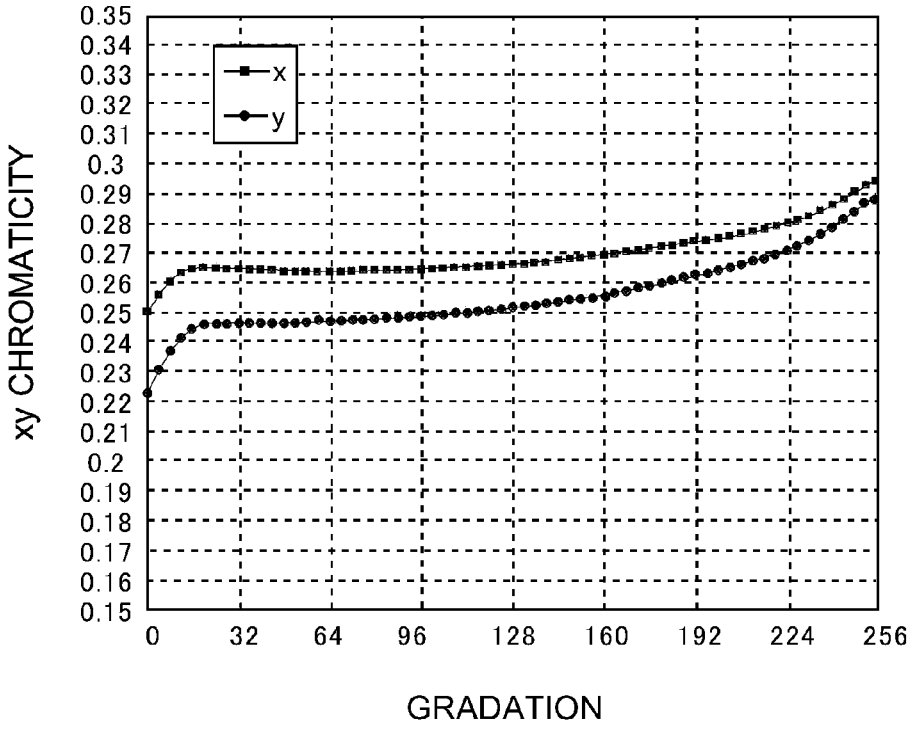
FIG. 4 is a graph illustrating an example of a gradation-chromaticity characteristic of a display panel in a state that the display panel displays white (grayscale colors)
Figure 6A:
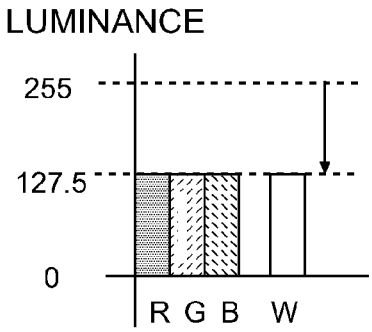
FIG. 6A and FIG. 6B are diagrams illustrating an example of a gradation conversion in a state that all the luminance values of R, G, B and W are the maximum value.
Figure 6B:
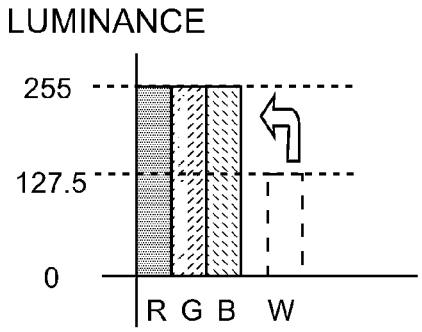
Figure 7A:
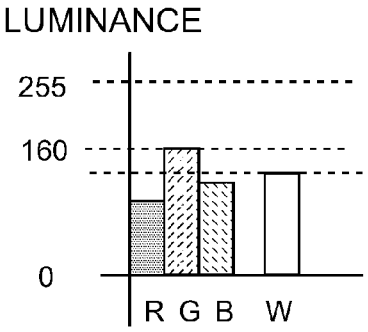
FIG. 7A and FIG. 7B are diagrams illustrating an example of a gradation conversion in a state that the luminance values of R, G, B and W are different from each other.
Figure 7B:
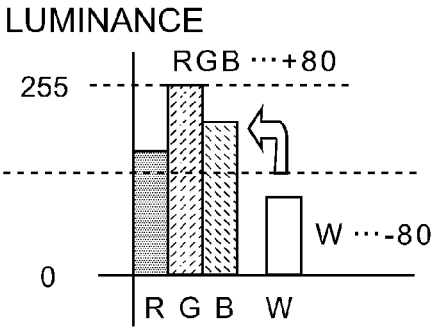
Figure 8:
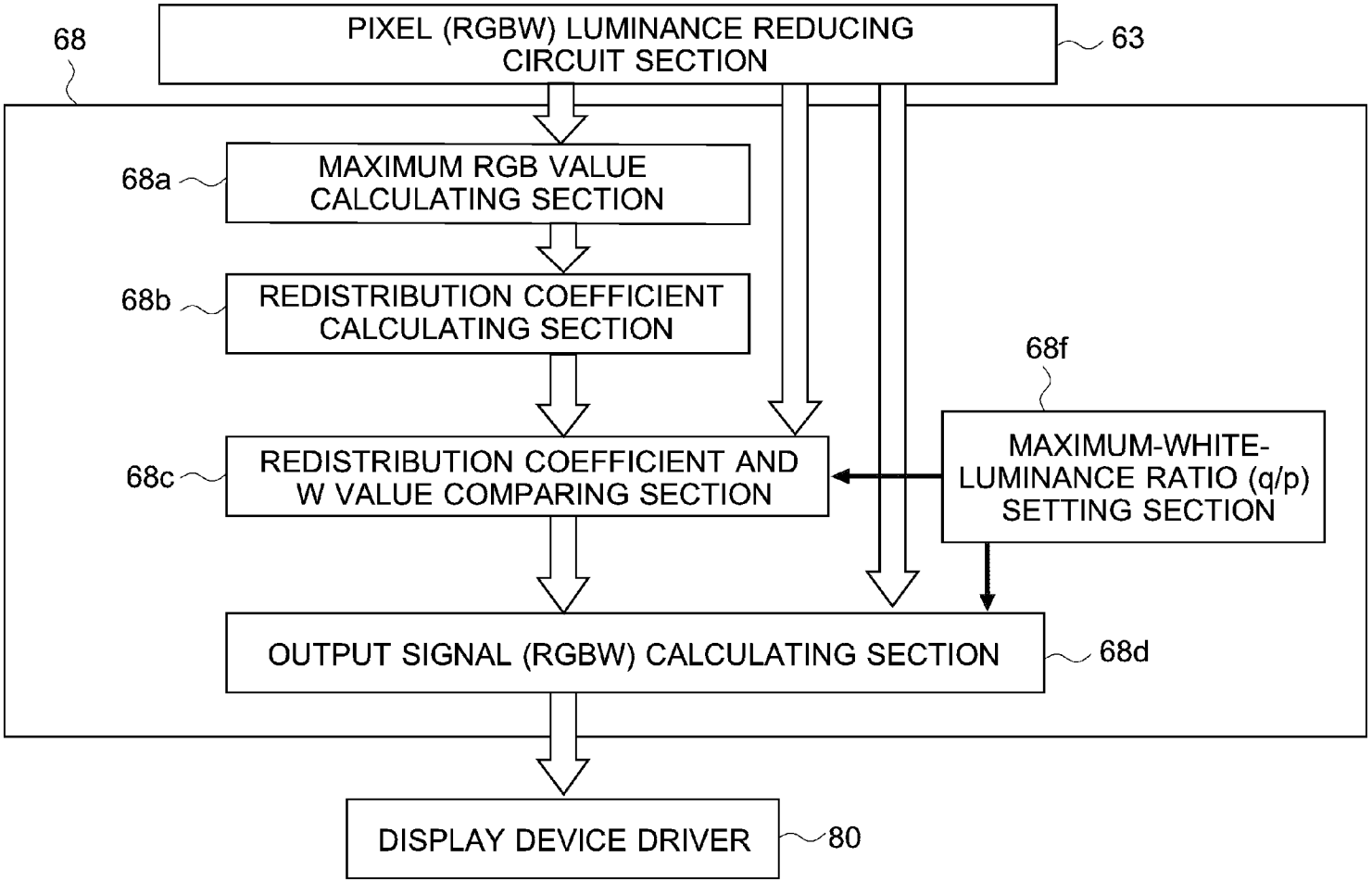
FIG. 8 is a block diagram illustrating a structural example of the W value redistributing circuit section relating to Example 1, in a state that the ratio of the maximum luminance component of white which can be created by R, G and B pixels to the maximum luminance component of white which can be created by a W pixel is p to q.

To illustrate the embodiments in more detail, there will be provided detailed descriptions about a control circuit and a display device equipped with the control circuit, relating to Example 1 with reference to FIGS. 1 to 8. FIG. 1 is a block diagram illustrating a structural example of a display device of the present example. FIG. 2 is a block diagram illustrating a structural example of an image signal processing circuit in the display device. FIG. 3 is a block diagram illustrating a structural example of a W value redistributing circuit section in the image signal processing circuit. FIG. 4 is a graph illustrating an example of a gradation-chromaticity characteristic of a display panel in a state that the display panel displays white (grayscale colors). FIG. 5A and FIG. 5B are diagrams illustrating a control of luminance of a display panel having dependence of white chromaticity on gradation values. FIGS. 6A and 6B and FIGS. 7A and 7B are diagrams illustrating an example of a gradation conversion in a state that all the luminance values of R, G, B and W are the maximum value, and diagrams illustrating an example of a gradation conversion in a state that the luminance values of R, G, B and W are different, respectively. FIG. 8 is a block diagram illustrating a structural example of the W value redistributing circuit section, in a state that the ratio of the maximum luminance component of white which can be created by R, G and B pixels to the maximum luminance component of white which can be created by a W pixel is p to q.

First, a display device of the present example is described with reference to FIG. 1. The display device is composed of elements including power supply source 10, image signal supply source 20, B/L (backlight) power supply source 30, signal processing substrate 40, B/L (backlight) drive substrate 70, display device driver 80, display device scan driver 90, image display section 100 and backlight 110. Signal processing substrate 40 is composed of elements including power generating circuit 50 and image signal processing circuit 60.

Signal processing substrate 40 is supplied with power by power supply source 10, and generates power for driving various ICs, using power generating circuit 50 such as a DC/DC convertor, to drive the various ICs. Signal processing substrate 40 is further supplied with image signals by image signal supply source 20, and conducts signal processing (including a signal array conversion and a generation of horizontal/vertical synchronization signals) for creating images to be displayed onto image display section 100, using image signal processing circuit 60. Signal processing substrate 40 supplies the resulting signals to display device driver 80 and display device scan driver 90, which results in images displayed onto image display section 100. A liquid crystal display devices needs a light source to be used for projecting images, and drives various signals and a circuit (B/L drive substrate 70) for making the backlight light up, using power supplied by B/L power supply source 30, to operate the backlight 110 to light up.

Next, image signal processing circuit 60 in the display device is described with reference to FIG. 2. Image signal processing circuit 60 is composed of elements including W value calculating circuit section 61, chroma complementing circuit section 62, pixel luminance reducing circuit section 63, pixel chroma calculating circuit section 64, maximum chroma calculating circuit section 65, pixel luminance increasing ratio calculating circuit section 66, B/L drive PWM signal generating section 67 and W value redistributing circuit section 68. Among these elements, W value calculating circuit section 61, chroma complementing circuit section 62, pixel luminance reducing circuit section 63, pixel chroma calculating circuit section 64, maximum chroma calculating circuit section 65, pixel luminance increasing ratio calculating circuit section 66 and W value redistributing circuit section 68 are defined as a first circuit section, because these elements are provided to generate control signals for controlling the RGBW display panel based on the inputted image signals. On the other hand, the B/L drive PWM signal generating section 67 to generate control signals for controlling the backlight based on the image signals is defined as a second circuit section.

Image signal processing circuit 60 receives image signals inputted by image signal (RGB) input section 21 as image signal supply source 20 and generates signals of W pixels by using W value calculating circuit section 61. Since making W pixels light up results in a whitish image, chroma complementing circuit section 62 conducts a chroma complementing processing. On the other hand, image signal processing circuit 60, based on the image signals inputted by image signal (RGB) input section 21, calculates chroma of each pixel by using pixel chroma calculating circuit section 64, calculates the maximum chroma value in one frame by using maximum chroma calculating circuit section 65, and further calculates an increasing ratio of the luminance of each pixel by using pixel luminance increasing ratio calculating circuit section 66. Based on the increasing ratio of the luminance of each pixel given by the pixel luminance increasing ratio calculating circuit section 66 and signals of R, G, B and W pixels given after the chroma complementing processing, image signal processing circuit 60 adjusts the luminance of each pixel by using pixel luminance reducing circuit section 63. According to the luminance increasing ratio of the pixel having the minimum luminance increasing ratio defined by the pixel luminance increasing ratio calculating circuit section 66, B/L drive PWM signal generating section 67 generates PWM signals and transmits the signals to B/L drive substrate 70.

When the display panel (image display section 100) has a dependence of the white chromaticity on gradation values, such a display panel can make a sense of strangeness about image quality. In view of that, W value redistributing circuit section 68 conducts processing so as to giving priority to the luminance and chromaticity of R, G and B pixels and converts the luminance signals into gradation values. The processed and converted signals are transmitted to display device driver 80. The processing of the W value redistributing circuit section 68 will be described in detail with reference to FIG. 3.

The W value redistributing circuit section 68, as illustrated in FIG. 3, is composed of elements including maximum RGB value calculating section 68*a*, redistribution coefficient calculating section 68*b*, redistribution coefficient and W value comparing section 68*c* and output signal (RGBW) calculating section 68*d*.

First, W value redistributing circuit section 68 receives RGBW signals generated by pixel luminance reducing circuit section 63, and maximum RGB value calculating section 68*a* calculates the maximum value among the RGB luminance signals. Based on the calculated value and the maximum value of possible luminance values which can be displayed on the image display section 100, redistribution coefficient calculating section 68*b* defines a redistribution coefficient for each W pixel. Next, redistribution coefficient and W value comparing section 68*c* makes a comparison and determines which of the luminance component of each W pixel and the luminance component of the redistribution coefficient is greater than the other. Output signal (RGBW) calculating section 68*d* defines RGBW output signals based on the determined result. The RGBW output signals are converted into gradation values and the resulting values are transmitted to display device driver 80.

Hereinafter, there will be given concrete descriptions about a way to generate RGBW signals and a way to conduct a luminance control by using image signal processing circuit 60 having the above-described construction. The description will be given by using processing based on luminance, in order to make the descriptions easier, however, the processing may be performed based on gradation values.

First, image signal processing circuit 60 receives RGB image signals (gradation values) inputted by image signal input section 21, and converts the image signals into luminance signals. After that, W value calculating circuit section 61 creates a luminance signal for each W pixels based on the luminance signals of corresponding R, G and B pixels. Concretely, when input luminance signals of R, G and B pixels are given as Rin, Gin and Bin, and the luminance signal of a W pixel to be generated is given as Wi, the value of Wi is defined as the minimum value among Rin, Gin and Bin as represented by the following formula (a).

$$Wi=\min(Rin,Gin,Bin) \quad (a)$$

Since operating W pixels to light up together with R, G and B pixels results in a whitish image in comparison with the original image, chroma complementing circuit section 62 complements chroma of the inputted signals according to the following formulas (b). With this processing, the chroma of the inputted signals are complemented, which avoids an occurrence of a sense of strangeness coming from the whitish image in comparison with the original image. In the following formulas, MIN represents the minimum value among Rin, Gin and Bin, and Max represents the maximum value among Rin, Gin and Bin, in other words, MIN and MAX are given by MIN=min(Rin, Gin, Bin) and MAX=max(Rin, Gin, Bin).

$$Rc=(1+(\mathrm{MIN}/\mathrm{MAX}))\times R\mathrm{in}-\mathrm{MIN}$$

$$Gc=(1+(\mathrm{MIN}/\mathrm{MAX}))\times G\mathrm{in}-\mathrm{MIN}$$

$$Bc=(1+(\mathrm{MIN}/\mathrm{MAX}))\times B\mathrm{in}-\mathrm{MIN} \quad \text{(b)}$$

Further, it is necessary to preliminary calculate chroma information of each unit pixel, for calculating the luminance of the backlight. Therefore, pixel chroma calculating circuit section 64 conducts a chroma calculation for each unit pixel according to the following formula (c). In the following formula, MIN represents the minimum value among Rin, Gin and Bin, and MAX represents the maximum value among Rin, Gin and Bin, in other words, MIN and MAX are given by MIN=min(Rin, Gin, Bin) and MAX=max(Rin, Gin, Bin).

$$\mathrm{chroma}=(\mathrm{MAX}-\mathrm{MIN})/\mathrm{MAX} \quad \text{(c)}$$

The value of "chroma" of the formula (c) is calculated for each unit pixel. The calculated value means that a concerned pixel has higher chroma as the calculated value is greater and that a concerned pixel has lower chroma as the calculated value is smaller. The value of chroma correlates with the lighting level of the corresponding W pixel. For example, when the calculation about a unit pixel in primary color is considered, chroma=1 holds for the pixel and the value of MIN becomes zero because of the formula (c). Therefore, the corresponding W pixel does not light up. As another example, when the calculation about a unit pixel in grayscale color, wherein the ratio of each of R, G and B are the same to each other, is considered, chroma=0 holds for the pixel and MAX=MIN holds because of the formula (c). Therefore, the corresponding W pixel lights up at the level equivalent to the luminance components of the concerned pixel. That is, as a unit pixel has lower chroma, the corresponding W pixel lights up at the higher level, and the other hand, as a unit pixel has higher chroma, the corresponding W pixel lights up at the lower level. Accordingly, the increasing amount of the luminance of a concerned unit pixel can be calculated by the chroma value of the concerned unit pixel. The increasing amount of the luminance of each unit pixel (LEH) can be calculated by the following formulas (d) by using each pixel luminance increasing ratio calculating circuit section 66 and maximum chroma calculating circuit section 65. In the formula, chroma(c) represents the chroma value of each unit pixel and is given by calculating the formula(c) using the luminance signals of each pixel. In the formula, chroma(max) represents the maximum value among chroma values in one frame.

$$LEH(c)=2-\mathrm{chroma}(c)$$

$$LEH(\mathrm{min})=2-\mathrm{chroma}(\mathrm{max}) \quad \text{(d)}$$

In the above formulas, LEH(c) represents the increasing amount of luminance of each unit pixel, and LEH(min) represents that of a unit pixel having the minimum increasing amount of luminance in one frame. As a unit pixel has higher chroma, the corresponding W pixel lights up at the lower level, and the reducing amount of the luminance of the backlight is defined based on the pixel whose increasing amount of luminance is the minimum in one frame. Therefore, according to the following formula (e), B/L drive PWM signal generating section 67 reduces the backlight luminance by the degree of LEH(min) of the formula (d).

$$PWM=1/LEH(\mathrm{min}) \quad \text{(e)}$$

The above-described calculation of "PWM" by the formula (e) is defined under the assumption that the backlight luminance is modulated by the PWM method. For example, PWM=0.8 means that the PWM value is set to 80%, and the luminance reducing amount becomes 20% in this case.

As described above, since the luminance reducing ratio of the backlight is defined based on the unit pixel whose luminance increasing amount is the minimum in one frame, the luminance increasing amount of each of the other unit pixels naturally has a value equal to or more than LEH(min) and these pixels can be set at the excessively high luminance level. To lower the excessively high luminance of each of the unit pixels, pixel luminance increasing ratio calculating circuit section 66 calculates an excess of luminance of each of the unit pixels according to the following formula (f).

$$LEH\mathrm{ratio}=LEH(c)/LEH(\mathrm{min}) \quad \text{(f)}$$

The reciprocal of "LEHratio" of the formula (f) gives the reducing amount for reducing the luminance of each of unit pixels which has been set at the excessively high luminance level. Pixel luminance reducing circuit section 63 determines RGBW signals according to the following formulas (g).

$$R\mathrm{out}=Rc/LEH\mathrm{ratio}$$

$$G\mathrm{out}=Gc/LEH\mathrm{ratio}$$

$$B\mathrm{out}=Bc/LEH\mathrm{ratio}$$

$$W\mathrm{out}=Wi/LEH\mathrm{ratio} \quad \text{(g)}$$

As described above, image signal processing circuit 60 converts RGBW luminance signals generated by the formulas (g) into gradation values and transmits the gradation values to B/L drive substrate 70. Then, the backlight control is conducted in the RGBW display device, so that the reduction of the electricity consumption of the backlight can be achieved.

Hereinafter, there is given an instance that the above control is conducted by using a display panel having a characteristic that the chromaticity changes corresponding to a change of the gradation value of grayscale color.

FIG. 4 illustrates an example of a gradation-chromaticity characteristic of the display panel in a state that the display panel displays white, black and grayscale colors. As can be seen from the graph of FIG. 4, the chromaticity value of white (a solid-color screen of the gradation value of 255) is located around (x, y)=(0.295, 0.290), and the chromaticity value of color of the gradation value of 186 (a solid-color screen of the gradation value of 186) is located around (x, y)=(0.275, 0.262). If a display panel having dependence of the chromaticity of white on gradation values is employed, the chromaticity value of white displayed on the display panel is changed due to a gradation conversion from the gradation value of 255 to that of 186. That is, yellowish white shown in the solid-color screen of the gradation value of 255 is changed to bluish white after the gradation conversion of the solid-color screen to the gradation value of 186.

Figure 5A:
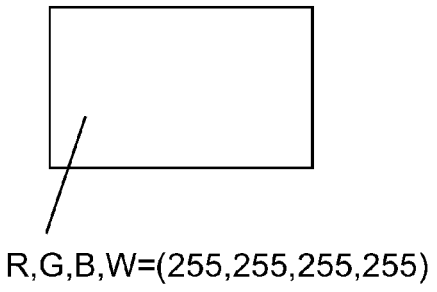
FIG. 5A and FIG. 5B are diagrams illustrating a control of luminance of a display panel having dependence of white chromaticity on gradation values.
Figure 5B:
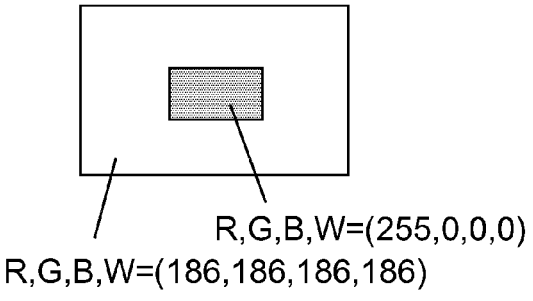

The characteristic of the display panel is described by using a concrete example of screens with reference to FIG. 5A and FIG. 5B. FIG. 5A illustrates screen A that is an all-white screen, and FIG. 5B illustrates screen B that a red window is displayed in an all-white screen. As for the screen A, a calculation of the above formulas (a) to (g) results in a reducing ratio of the backlight luminance of 50%, and RGBW gradation values become (255, 255, 255, 255). On the other hand, if a red window (255, 0, 0, 0) is displayed inside the all-white screen, a calculation of the above formulas (a) to (g) results in a reducing ratio of the backlight luminance of 0%. In the area in white, the luminance needs to be reduced by 50% as illustrated in FIG. 6A, and RGBW gradation values in this area become (186, 186, 186, 186).

When a RGBW display device employs the display panel having the dependence of the white chromaticity on gradation values as illustrated in FIG. 4, and the drive of the display panel of the RGBW display device, which includes control of the backlight luminance, is conducted, a switching operation of a screen displayed on the display panel from screen A to screen B makes a change in color of the white area in the screen from yellowish white to bluish white. Such change is perceived by users as a sense of strangeness about quality of displayed image.

In view of that, the present example provides a control of a display panel of a RGBW display panel so as to minimize a change in the chromaticity of white coming from the gradation conversion and not to cause the sense of strangeness about image quality even when conducting drive of a RGBW display panel having the characteristic illustrated in FIG. 4, where the drive includes a luminance control of a backlight of the display device.

There is given a concrete example of the control below. In the case that the image signal processing circuit 60 receives input image signals of an all-white screen (a solid-color screen of the gradation value of 255), the chromaticity of the white on the screen displayed on the display panel is represented as (x, y)=(0.295, 0.290) by using the chromaticity values shown in FIG. 4. In another case that the image signal processing circuit 60 receives input image signals of a screen in middle tone color (gray), in which the RGB gradation values are the same to each other and the luminance is reduced by half, in other words, a solid-color screen in gray (middle tone color) of the gradation value of 186, the chromaticity of the color is represented as (x, y)=(0.275, 0.262). When the chromaticity variation in this case is assumed to be denoted by (Δx1, Δy1), the chromaticity variation can be represented by (Δx1, Δy1)=(0.020, 0.028).

On the other hand, in another case that the display panel of the RGBW display device is operated to display the screen that an all-white screen is combined with a window in a primary color as illustrated in FIG. 5B, since the gradation value of the white area is changed from 255 to 186, the chromaticity of the white area is also represented as (x, y)=(0.275, 0.262). When the chromaticity variation in this case is assumed to be denoted by (Δx2, Δy2), the chromaticity variation can be represented by (Δx2, Δy2)=(0.020, 0.028).

It means that the chromaticity value of white of the white area in the screen in which the all-white screen is combined with the window in a primary color differs from the chromaticity value of white of the all-white screen, though both chromaticity values should be the same (because the latter screen has been prepared just by adding a primary-color area to the all-white screen). This issue can cause a sense of strangeness about quality of a displayed image.

The issue can be solved by controlling the display panel so as to make the chromaticity variation (Δx2, Δy2) always smaller than the chromaticity variation (Δx1, Δy1), even under the state that the display device displays, for example, a screen such that half of the all-white screen is replaced with an area in a primary color (just one selected from R, G and B). From an idealistic viewpoint, no such chromaticity variation is preferably caused. Therefore, the chromaticity variation (Δx2, Δy2) preferably becomes (Δx2, Δy2)=(0, 0).

The present example employs W value redistributing circuit section 68 to conduct the above-described control. Hereinafter, with reference to FIG. 3, there will be given descriptions about a way to redistribute the luminance of each W pixel, in concrete terms, the way to receive the luminance signals of RGBW pixels and redistribute the luminance of each W pixel to corresponding RGB pixels so as to give priority to the luminance components and chromaticity components of the corresponding RGB pixels rather than the luminance component and chromaticity component of each W pixel.

First, maximum RGB value calculating section 68*a* calculates the maximum value of the luminance components of RGB pixels, by using the following formula (h), where Rout, Gout and Bout are the luminance components of RGB pixels, and MAXrgb is the maximum value among those luminance components.

$$MAXrgb=\max(Rout,Gout,Bout) \quad \text{(h)}$$

Next, redistribution coefficient calculating section 68*b* calculates a redistribution coefficient "W_coef" to be used for defining the redistribution extent of the luminance of a W pixel, by using the following formula (i).

$$W_coef=f(n)-MAXrgb \quad \text{(i)}$$

In the formula (i), f(n) denotes the maximum value of possible luminance values which can be displayed on the display panel, in the luminance signals. For example, the value of f(n) is 255 for a 8-bit system, and that is 1023 for a 10-bit system. As another example, the value is given as 255×16=4080 for a system that 8-bit resolution is extended by 4 bit.

Next, redistribution coefficient and W value comparing section 68*c* compares the magnitude of the redistribution coefficient and that of the luminance component of a W pixel, and output signal (RGBW) calculating section 68*d* calculates RGBW output signals Rw, Gw, Bw and Ww. If the redistribution coefficient is greater, since all the luminance component of the W pixel can be distributed to the corresponding RGB pixels, the output signal (RGBW) calculating section 68*d* adds the value of the luminance component of the W pixel, to the luminance component of each of the RGB pixels, and set the luminance of the W pixel at zero. If the luminance component of the W pixel is greater, the output signal (RGBW) calculating section 68*d* adds just the value of the redistribution coefficient, to the luminance component of each of the RGB pixels, and subtracts the value of the redistribution coefficient from the luminance of the W pixel. The following formulas (j-1) and (j-2) represent the above processing in a form of numerical expressions.

For $Wout>W_coef$, $Rw=Rout+W_coef$, $Gw=Gout+W_coef$, $Bw=Bout+W_coef$, and $Ww=Wout-W_coef$; and (j-1)

For $Wout\leq W_coef$, $Rw=Rout+Wout$, $Gw=Gout+Wout$, $Bw=B\text{out}+W\text{out}$, and $Ww=0$ (j-2)

As can be seen from the formulas (j-1) and the formulas (j-2), the signals obtained by those formulas have the following characteristics. In the case that a W pixel lights up, in other words, in the case of the formulas (j-1), the maximum value among the luminance components of RGB pixels always has the same value to the maximum value of the luminance which can be displayed. In the case of the formulas (j-2), a W pixel does not light up because Ww=0 holds. Concretely, the formula (i) can be rewritten as the following formula (i').

$f(n)=\text{MAX}rgb+W_\text{coef}$ (i')

From the formula (h), MAXrgb=max(Rout, Gout, Bout) can be obtained. Therefore, it is found that any of Rw, Gw and Bw (which can be two or all of the three) becomes f(n).

In the above descriptions, when W value redistributing circuit section 68 did not work, the gradation values of RGBW pixels in the white area in the case that the display panel displays the all-white screen with a red window as illustrated in FIG. 5B, became R, G, B, W=(186, 186, 186, 186), which corresponds to the diagram illustrated in FIG. 6A. When W value redistributing circuit section 68 worked, as illustrated in FIG. 6B, processing of redistributing the luminance of each W pixel is additionally performed and the gradation values became R, G, B, W=(255, 255, 255, 0), which enables the control of display panel with giving priority to the luminance and chromaticity of each of RGB pixels with maintaining the luminance and chromaticity equivalent to the original image. Therefore, even if the display panel switches a screen which is displayed thereon, from the screen A illustrated in FIG. 5A to the screen B illustrated in FIG. 5B, such an operation do not change the color tone of the white area, which allows the display panel not to cause a sense of strangeness about a displayed image.

The above-described control is applied not only to an all-white screen, but can also restrict a change of color tone of a screen in a middle tone color such as a grayscale color. Even in an instance that the luminance values of RGB pixels are not uniform as illustrated in FIG. 7A (that is, an instance that the concerned color is white lightly tinted with any other color), W value redistributing circuit section 68 conducts the redistributing processing with giving priority to the luminance and chromaticity of each of RGB pixels rather than those of a W pixel as illustrated in FIG. 7B, so that a change of the color tone of white coming from a gradation conversion can be minimized. Such processing allows a drive of a display panel of a RGBW display device including a luminance control of the backlight, with suppressing the sense of strangeness about quality of a displayed image.

The above descriptions about a RGBW display device were given under the assumption that the ratio of the maximum-white-luminance component, which is the ratio the maximum luminance component of white which can be created by each white pixels to the maximum luminance component of white which can be created by the corresponding RGB pixels, is 1 to 1. However, the ratio of the maximum-white-luminance component is not limited to 1 to 1. If the ratio has different values, the luminance component of each white pixel is preferably distributed to corresponding RGB pixels with the maximum white-luminance component ratio considered.

For example, when the ratio of the maximum luminance component of white which can be created by the a W pixel to the maximum luminance component of white which can be created by the corresponding RGB pixels is q to p, (where each of p and q is an arbitrary real number), distribution of the luminance value of a W pixel to RGB pixels in a simple manner results in an increase of the luminance value by p/q times. Therefore, when distributing the luminance component of white light of a W pixel to RGB pixels, maximum-white-luminance ratio setting section 68*f* illustrated in FIG. 8 may previously multiply Wout of the formulas (j-1) and (j-2) by q/p (the luminance component of a W pixel/the luminance components of RGB pixels). If the luminance component of a W pixel do not become zero as a result of the distribution (in an instance that Wout>W_coef of the formula (j-1) holds), the value of Ww needs to be multiplied by p/q, which is the reciprocal of q/p, to be made the original luminance component of the W pixel. This processing is represented by the following formulas (k-1) and formulas (k-2), in numerical expressions.

For $(q/p)\times W\text{out}>W_\text{coef}$, $Rw=R\text{out}+W_\text{coef}$, $Gw=G\text{out}+W_\text{coef}$, $Bw=B\text{out}+W_\text{coef}$, and $Ww=(p/q)\times((q/p)\times W\text{out}-W_\text{coef}))$; and (k-1)

For $(q/p)\times W\text{out}\leq W_\text{coef}$, $Rw=R\text{out}+(q/p)\times W\text{out}$, $Gw=G\text{out}+(q/p)\times W\text{out}$, $Bw=B\text{out}+(q/p)\times W\text{out}$, and $Ww=0$ (k-2)

Accordingly, under the state that the ratio of the maximum-white-luminance component, which is the ratio of a maximum luminance component of white which can be created by each W pixel to a maximum luminance component of white which can be created by the corresponding RGB pixels, is not 1 to 1, the processing of redistributing the luminance of the W pixel is also valid.

Example 2

Figure 9:
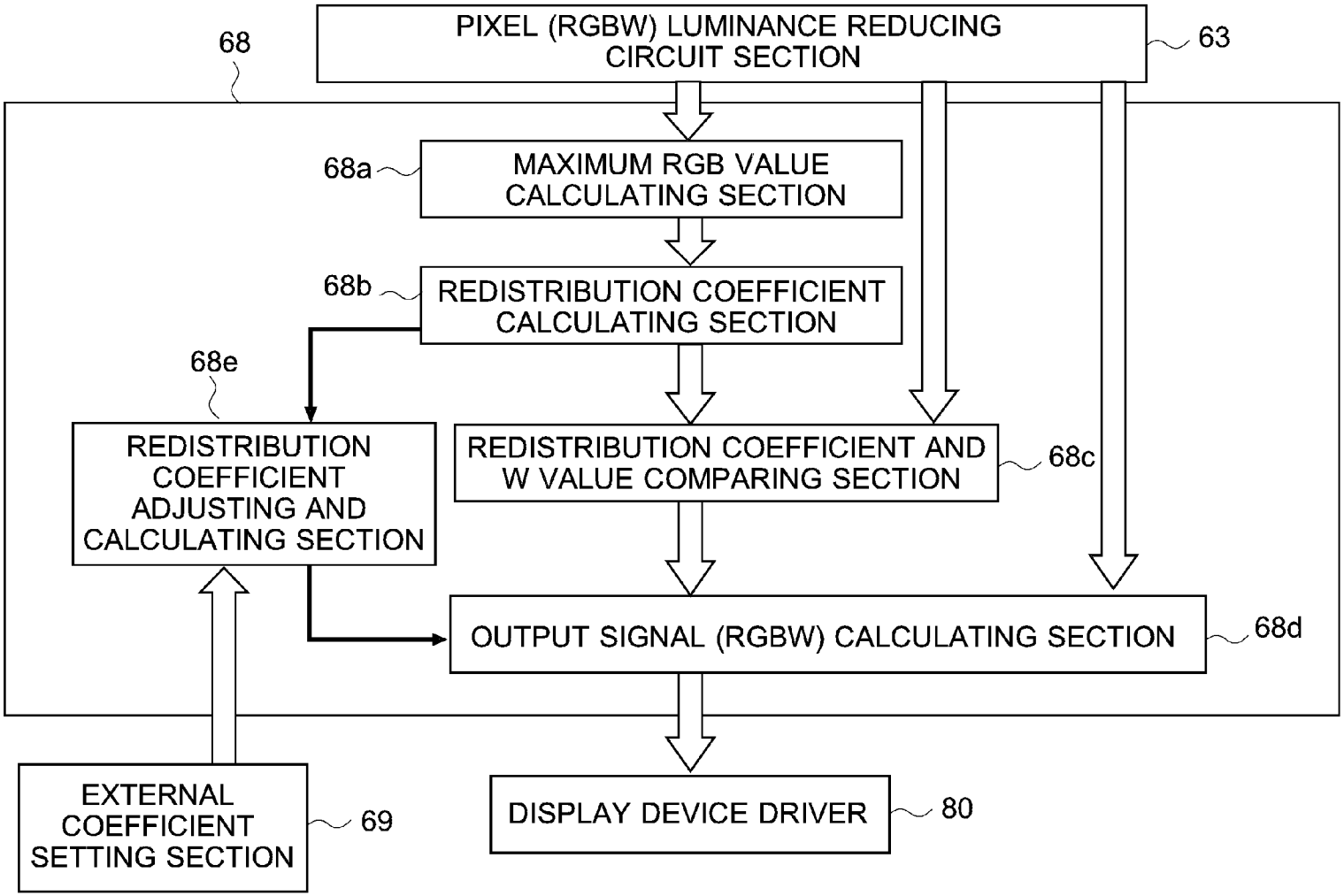
FIG. 9 is a block diagram illustrating a structural example of a W value redistributing circuit section relating to Example 2.
Figure 10:
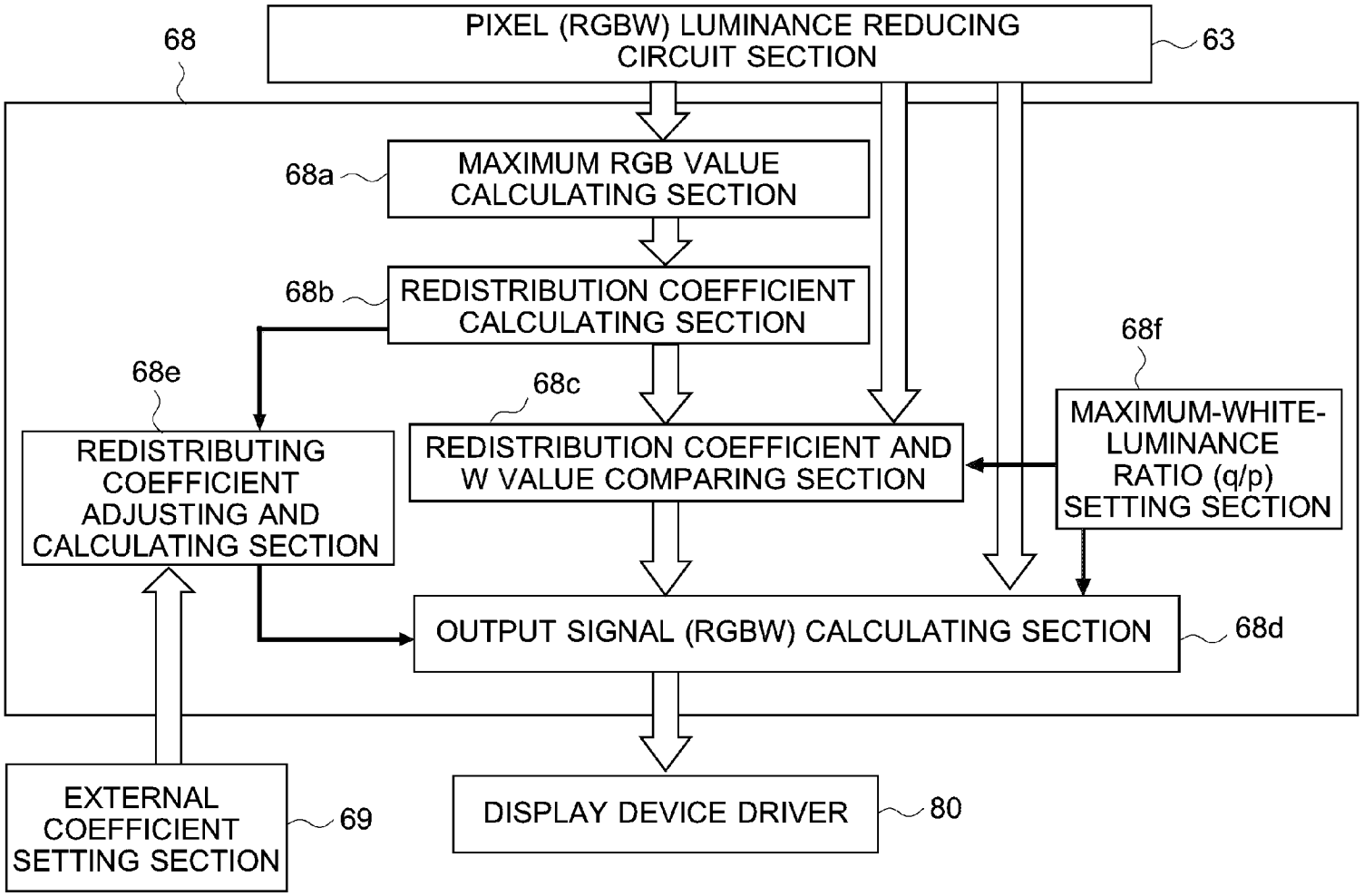
FIG. 10 is a block diagram illustrating a structural example of the W value redistributing circuit section relating to Example 2, in an instance that the ratio of the maximum luminance component of white which can be created by R, G and B pixels to the maximum luminance component of white which can be created by a W pixel is p to q.

Next, a control circuit relating to Example 2 and a display device equipped with the control circuit will be described with reference to FIG. 9 and FIG. 10. FIG. 9 is a block diagram illustrating a structural example of a W value redistributing circuit section in an image signal processing circuit. FIG. 10 is a block diagram illustrating a structural example of the W value redistributing circuit section, in an instance that the ratio of a maximum luminance component of white which can be created by each W pixel to a maximum luminance component of white which can be created by the corresponding RGB pixels is q to p.

Regarding the construction of the control circuit of Example 2, descriptions about W value redistributing circuit section 68 illustrated in FIG. 9, which differs from the construction of Example 1, will be given. As illustrated in FIG. 9, W value redistributing circuit section 68 is composed of elements including maximum RGB value calculating section 68*a*, redistribution coefficient calculating section 68*b*, redistribution coefficient and W value comparing section 68*c*, output signal (RGBW) calculating section 68*d*, redistribution coefficient adjusting and calculating section 68*e* and external coefficient setting section 69.

First, W value redistributing circuit section 68 receives RGBW signals generated by pixel luminance reducing circuit section 63, and maximum RGB value calculating section 68*a* calculates the maximum value among the RGB luminance signals. Based on the calculated value and the maximum value of possible luminance values, which can be displayed on the image display section 100, redistribution coefficient calculating section 68*b* defines a redistribution coefficient for each of the W pixels. Next, redistribution coefficient and W value comparing section 68*c* makes a comparison and determines which of the luminance component of a W pixel and the luminance component of the redistribution coefficient is greater than the other. Next, based on the redistribution coefficient calculated by the redistribution coefficient calculating section 68*b*, redistribution coefficient adjusting and calculating section 68*e* defines a distribution extent of the luminance component of each W pixel. If it is necessary, the coefficient may be set by external coefficient setting section 69. Then, based on the distribution extent and the result of the definition of the redistribution coefficient and W value comparing section 68*c*, output signal (RGBW) calculating section 68*d* defines RGBW output signals. The RGBW output signals are converted into gradation values and the resulting values are transmitted to display device driver 80.

In other words, Example 2 does not employ the construction that the W value redistributing circuit section 68 redistributes all the luminance value which can be redistributed to RGB pixels, which has been employed in Example 1, but employs another construction that W value redistributing circuit section 68 multiplies the maximum value of possible luminance values which can be redistributed to RGB pixels by a certain factor so as to adjust the redistribution extent. Hereinafter, the way to receive luminance signals of RGBW pixels generated by the above-described formulas (g) and redistributes the luminance of a W pixel so as to give priority to the luminance coefficients and the chromaticity coefficients of the corresponding RGB pixels rather than the luminance coefficient and the chromaticity coefficient of the W pixel, with reference to FIG. 9. In the following, there will be given descriptions concentrating on points which differ from Example 1.

First, maximum RGB value calculating section 68*a* calculates the maximum value among the luminance components of RGB pixels, by using the following formula (h), which is the same as that of Example 1.

$$\mathrm{MAX}rgb=\max(R\mathrm{out},G\mathrm{out},B\mathrm{out}) \tag{h}$$

Next, redistribution coefficient calculating section 68*b* calculates a redistribution coefficient "W_coef" to be used for defining the redistribution extent of the luminance of a W pixel, by using the following formula (i), which is the same as that of Example 1.

$$W_\mathrm{coef}=f(n)-\mathrm{MAX}rgb \tag{i}$$

In the formula (i), f(n) denotes the maximum value of possible luminance values, which can be displayed in the display panel, in the luminance signals. For example, the value of f(n) is 255 for a 8-bit system, and that is 1023 for a 10-bit system. As another example, the value is given as 255×16=4080 for a system that 8-bit resolution is extended by 4 bit.

Next, redistribution coefficient and W value comparing section 68*c* compares the magnitude of the redistribution coefficient and that of the luminance component of a W pixel. In Example 1, when the redistribution coefficient was greater, since whole the luminance component of the W pixel could be distributed to the corresponding RGB pixels, output signal (RGBW) calculating section 68*d* added the value of the luminance component of the W pixel to the luminance component of each of the corresponding RGB pixels, and set the luminance of the W pixel to zero. In Example 2, when the redistribution coefficient is greater than the luminance component of a W pixel, it is provided processing to distribute a part of the luminance component of the W pixel to the corresponding RGB pixels, though all the luminance component (Wout) of the W pixel could be distributed to the corresponding RGB pixels theoretically.

When a factor for distributing the luminance component of a W pixel to corresponding RGB pixels is assumed as "α", the luminance component to be distributed to the RGB pixels are given as α×Wout and the luminance component of the W pixel is given as (1−α)×Wout. In this calculation, the total luminance component of the W pixel after the distribution needs to have the same amount as that before the distribution, since the change of the total luminance component of a W pixel can affect the luminance balance. Therefore, the final luminance component of the W pixel is given as Wout×(1−α), which is calculated by subtracting the luminance component to be added to each of RGB pixels from the luminance component of the W pixel.

On the other hand, when the luminance component of the W pixel is greater than the redistribution coefficient, a part of the luminance component of a W pixel is also distributed to the corresponding RGB pixels. When a factor for distributing the luminance component of a W pixel to the corresponding RGB pixels is assumed as "β", the luminance component to be distributed to the RGB pixels are given as β×Wcoef and the luminance component of the W pixel are given as Wout−β×Wcoef. The total luminance component of the W pixel after the distribution also needs to have the same amount as that before the distribution, since the change of the total luminance component of a W pixel can affect the luminance balance. The following formulas (l-1) and formulas (l-2) represent the above processing (calculation of RGBW output signals, Rw, Gw, Bw, Ww) in a form of numerical expressions, where α is a real number satisfying 0<α<1 and β is a real number satisfying 0<β<1.

For $W\mathrm{out}\leq W_\mathrm{coef}$:

$$Rw=R\mathrm{out}+(W\mathrm{out}\times\alpha),$$

$$Gw=G\mathrm{out}+(W\mathrm{out}\times\alpha),$$

$$Bw=B\mathrm{out}+(W\mathrm{out}\times\alpha),\text{and}$$

$$Ww=W\mathrm{out}\times(1-\alpha);\text{ and} \tag{l-1}$$

For $W\mathrm{out}>W_\mathrm{coef}$:

$$Rw=R\mathrm{out}+(W_\mathrm{coef}\times\beta),$$

$$Gw=G\mathrm{out}+(W_\mathrm{coef}\times\beta),$$

$$Bw=B\mathrm{out}+(W_\mathrm{coef}\times\beta),\text{ and}$$

$$Ww=W\mathrm{out}-(W_\mathrm{coef}\times\beta) \tag{l-2}$$

In the above descriptions, when W value redistributing circuit section 68 did not work, the gradation values of RGBW pixels in the white area in the case that the display panel displays the all-white screen with a red window as illustrated in FIG. 5B, became R, G, B, W=(186, 186, 186, 186). When W value redistributing circuit section 68 worked, processing of redistributing the luminance of each W pixel, which is illustrated in FIG. 9, is additionally performed, which enables the control circuit to give priority to the luminance and chromaticity of each of RGB pixels with maintaining the luminance and chromaticity equivalent to the original image. Therefore, even if the display panel switches a screen which is displayed thereon, from the screen A illustrated in FIG. 5A to the screen B illustrated in FIG. 5B, such operations do not change the color tone of the white area, which allows the display device not to cause a sense of strangeness about a displayed image.

Hereinafter, as a concrete example about redistributing processing, there will be given description about how changes the luminance when the value of a is set at 0.8. In the following descriptions, it is assumed that RGBW gradation signals are 8-bit signals and the maximum gradation value is 255.

It is assumed that the final RGBW gradation signals were R, G, B, W=(186, 186, 186, 186) when W value redistributing circuit section 68 did not work. These values are processed by W value redistributing circuit section 68 which employs the formulas (l-1) and the formulas (l-2). When the value of a is set to 0.8 and the gradation signals of R, G, B and W pixels are converted into luminance information (where $\gamma$=2.2), the relative luminance information is given as R, G, B, W=(0.5, 0.5, 0.5, 0.5). Since $\alpha$ has been set to 0.8, the luminance information after the redistribution of the luminance component of a W pixel is given as R, G, B, W=(0.9, 0.9, 0.9, 0.1), from the formulas (l-1) and the formulas (l-2).

Finally, when the given values are converted into the actual gradation information, the gradation information can be represented by R, G, B, W=(243, 243, 243, 90). Such processing enables redistribution of the luminance component of each W pixel to the luminance components of the corresponding RGB pixels, without changing the total luminance. As can be seen from FIG. 4, in the case that the gradation value of each of RGB pixels is 186, the white chromaticity became about (x, y)=(0.275, 0.262). However, after the redistribution of the luminance of each W pixel, the white chromaticity becomes (x, y)=(0.290, 0.282). That is, the redistribution can bring white chromaticity of the luminance of a W pixel closer to the original white chromaticity (x, y)=(0.295, 0.290), and can minimize a change of the color tone.

Here, the reason for reducing the extent of redistribution of the W-luminance is described. For example, in the processing such that the luminance is fit with the curve of $\gamma$=2.2, conversion of the luminance information into the gradation information provides a greater change of a gradation value with respect to the luminance around lower gradation values, which results in a greater gradation difference. In a display panel having a characteristic that viewing-angle dependence (the rate of change in luminance or other property caused when the viewing angle is changed) is large, gradation with the great change rate can give a conspicuous luminance difference, which makes users feel a sense of strangeness about image quality. Especially, in a pixel having any one of zero and several to several tens gradation values, a luminance difference coming from a change of the viewing angle becomes conspicuous.

This issue can be solved by remaining a certain extent of the luminance component of each W pixel. In other words, by adjusting the redistribution extent of the luminance component of each W pixel, the luminance difference can be minimized with the white chromaticity made closer to the original white chromaticity coming from RGB pixels, even when the viewing angle is changed. Naturally, for a display panel having gradation dependence but inconspicuous viewing-angle dependence, the redistributing extent of the luminance component of each W pixel should be maximum.

As a result of the inventor's verification of actual image quality, it has been found that excessively small $\alpha$ and $\beta$ values can make the change of the white chromaticity coming from the gradation dependence conspicuous and those values are preferably set to a value in the range of $1>\alpha\geq0.5$ and a value in the range of $1>\beta\geq0.5$.

With the above-described processing, there can be provided drive of the display panel with giving priority to the luminance and the chromaticity of each of RGB pixels while keeping the luminance and the chromaticity equivalent to those of the original image as much as possible. Therefore, even if the display panel switches a screen which is displayed thereon, from the screen A illustrated in FIG. 5A to the screen B illustrated in FIG. 5B, such processing minimizes a change in color tone of the white area and minimizes a difference in luminance which can be caused around lower gradation values even if the viewing angle is changed, which allows the display panel not to cause a sense of strangeness about image quality.

The above-described processing can be applied not only to an all-white screen, but can also restrict a change of color tone of a screen in a middle tone color such as a grayscale color. Even in an instance that the luminance levels of RGB pixels are not uniform as illustrated in FIGS. 7A and 7B (that is, an instance that the concerned color is white lightly tinted with any other color), W value redistributing circuit section 68 conducts processing with giving priority to the luminance and chromaticity of each of RGB pixels rather than those of a W pixel, so that a change of the color tone of white coming from a gradation conversion can be minimized. Such processing allows a drive of a display panel of a RGBW display device including a luminance control of the backlight, with suppressing the sense of strangeness about image quality.

The above descriptions about a RGBW display device were given under the assumption that the ratio of the maximum-white-luminance component, which is the ratio of the maximum luminance component of white which can be created by each W pixel to the maximum luminance component of white which can be created by the corresponding RGB pixels, is 1 to 1, which is similar to Example 1. Alternatively, when the ratio of the maximum luminance component of white which can be created by the corresponding RGB pixels to that of white which can be created by the each W pixel is p to q (where each of p and q is an arbitrary real number), distribution of the luminance value of the W pixel to corresponding RGB pixels can be conducted by the following processing. That is, maximum-white-luminance ratio setting section 68*f* illustrated in FIG. 10 multiplies Wout of the formulas (l-1) and (l-2) by q/p, for $(q/p)\times Wout\leq W_coef$; and multiplies the value of Ww by p/q, for $(q/p)\times Wout>W_coef$. The following formulas (m-1) and formulas (m-2) represent the above processing (calculation of RGBW output signals, Rw, Gw, Bw, Ww) in a form of numerical expressions, where a is a real number satisfying $0<\alpha<1$ and $\beta$ is a real number satisfying $0<\beta<1$.

$$\text{For } (q/p)\times W\text{out}\leq W_\text{coef},$$

$$Rw=R\text{out}+(q/p)\times(W\text{out}\times\alpha),$$

$$Gw=G\text{out}+(q/p)\times(W\text{out}\times\alpha),$$

$$Bw=B\text{out}+(q/p)\times(W\text{out}\times\alpha), \text{ and}$$

$$Ww=(q/p)\times W\text{out}\times(1-\alpha); \text{ and} \qquad \text{(m-1)}$$

$$\text{For } (q/p)\times W\text{out}>W_\text{coef},$$

$$Rw=R\text{out}+(W_\text{coef}\times\beta),$$

$$Gw=G\text{out}+(W_\text{coef}\times\beta),$$

$Bw = B\text{out} + (W_\text{coef} \times \beta)$, and $$Ww = (p/q) \times ((q/p) \times W\text{out} - (W_\text{coef} \times \beta)) \quad \text{(m-2)}$$

Accordingly, under the state that the ratio of the maximum-white-luminance component, which is the ratio of a maximum luminance component of white which can be created by each W pixel to a maximum luminance component of white which can be created by the corresponding RGB pixels, is not 1 to 1, the processing of redistributing the luminance of the W pixel is also valid.

Example 3

Figure 11:
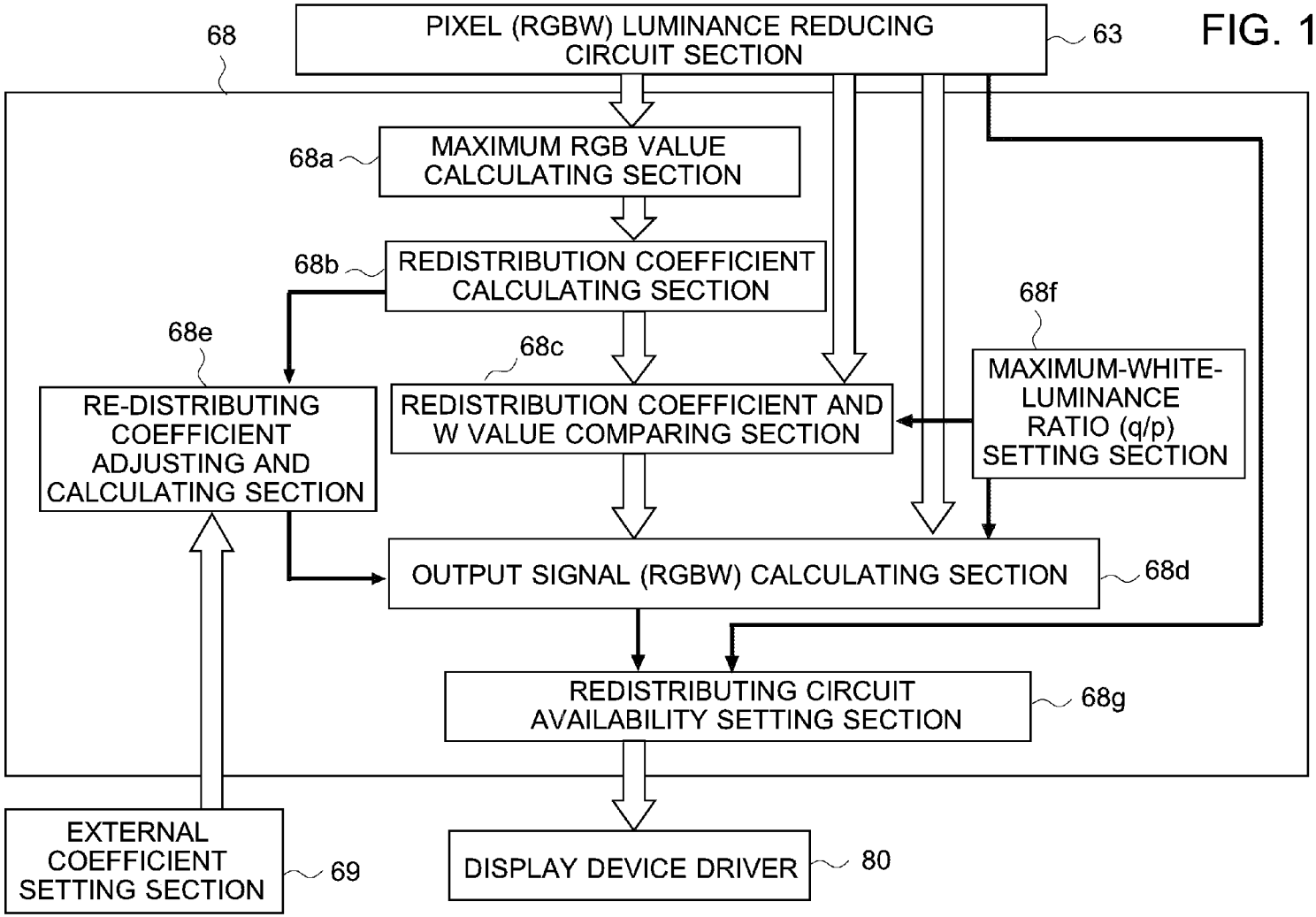
FIG. 11 is a block diagram illustrating a structural example of the W value redistributing circuit section in which an availability of the W value redistributing circuit section can be set, relating to Example 3.
Figure 12:
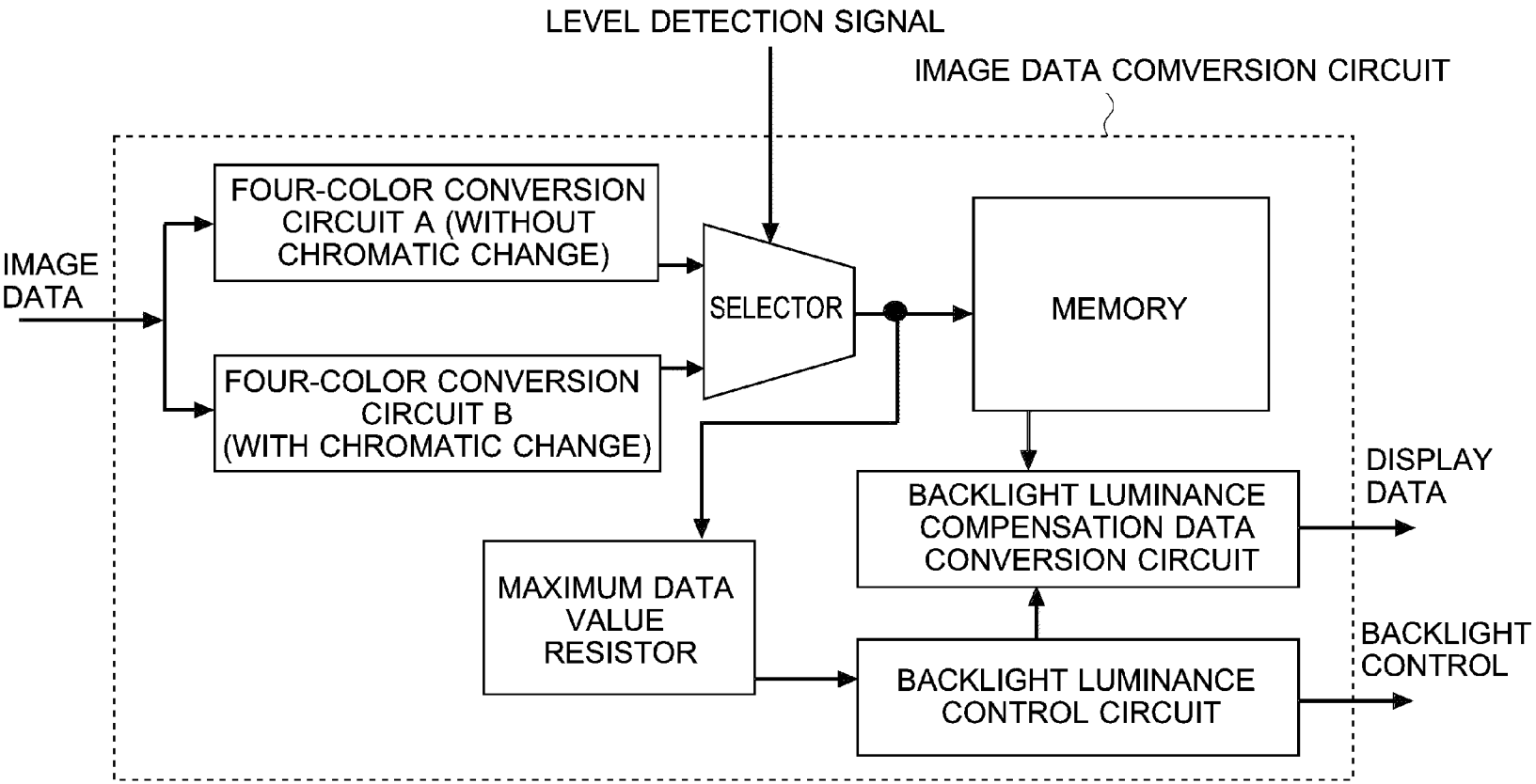
FIG. 12 RELATED ART
FIG. 12 is a representative diagram of a conventional art.
Figure 13:
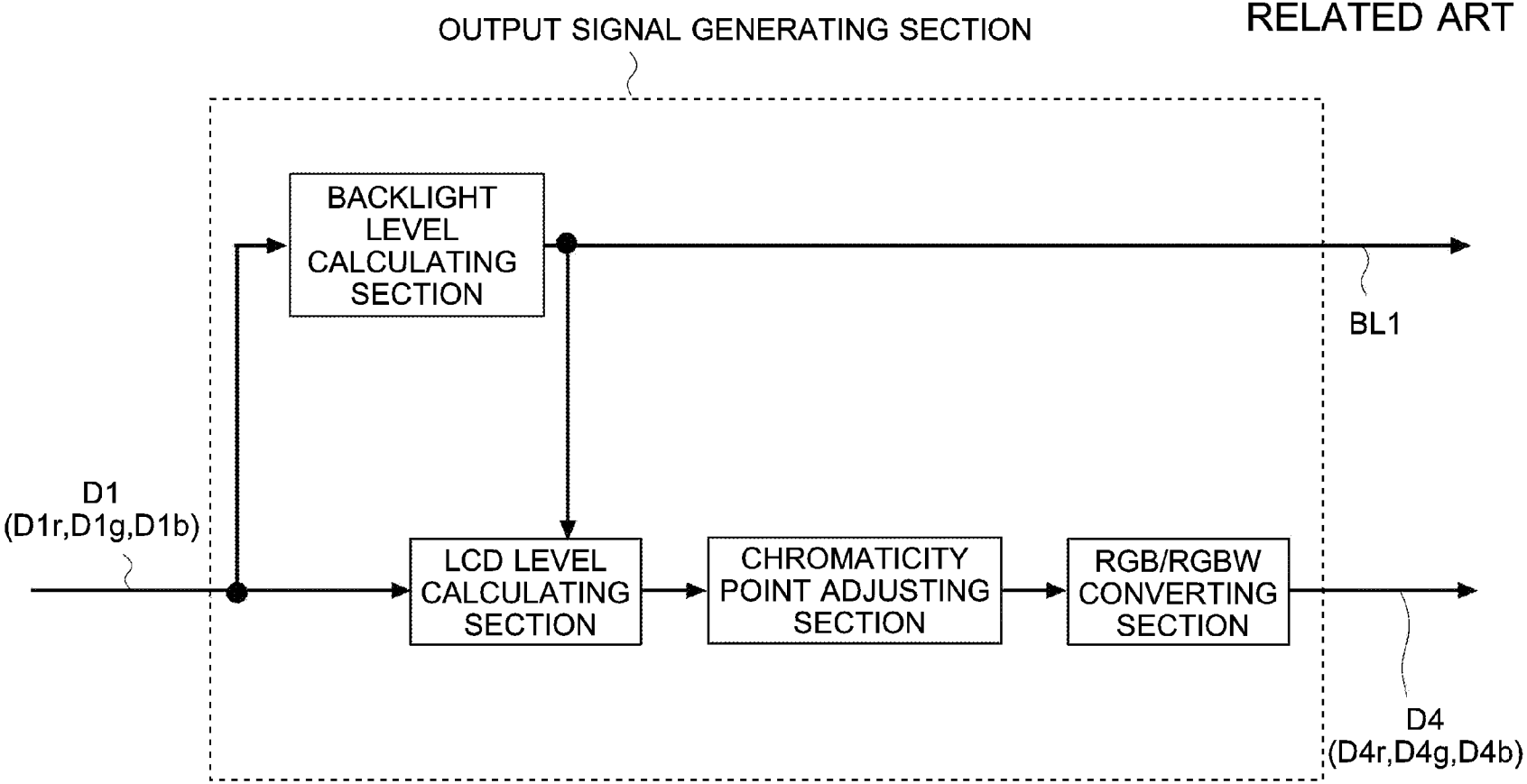
FIG. 13 RELATED ART
FIG. 13 is a representative diagram of another conventional art.
Figure 14:
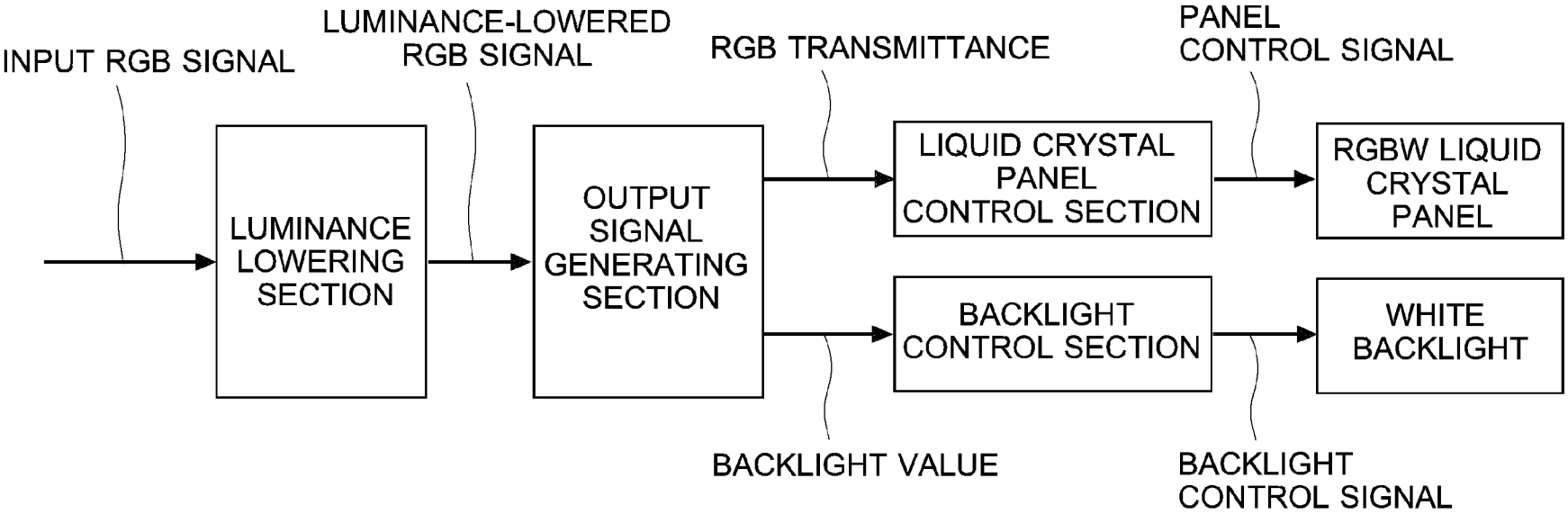
FIG. 14 RELATED ART
FIG. 14 is a representative diagram of another conventional art.
Figure 15:
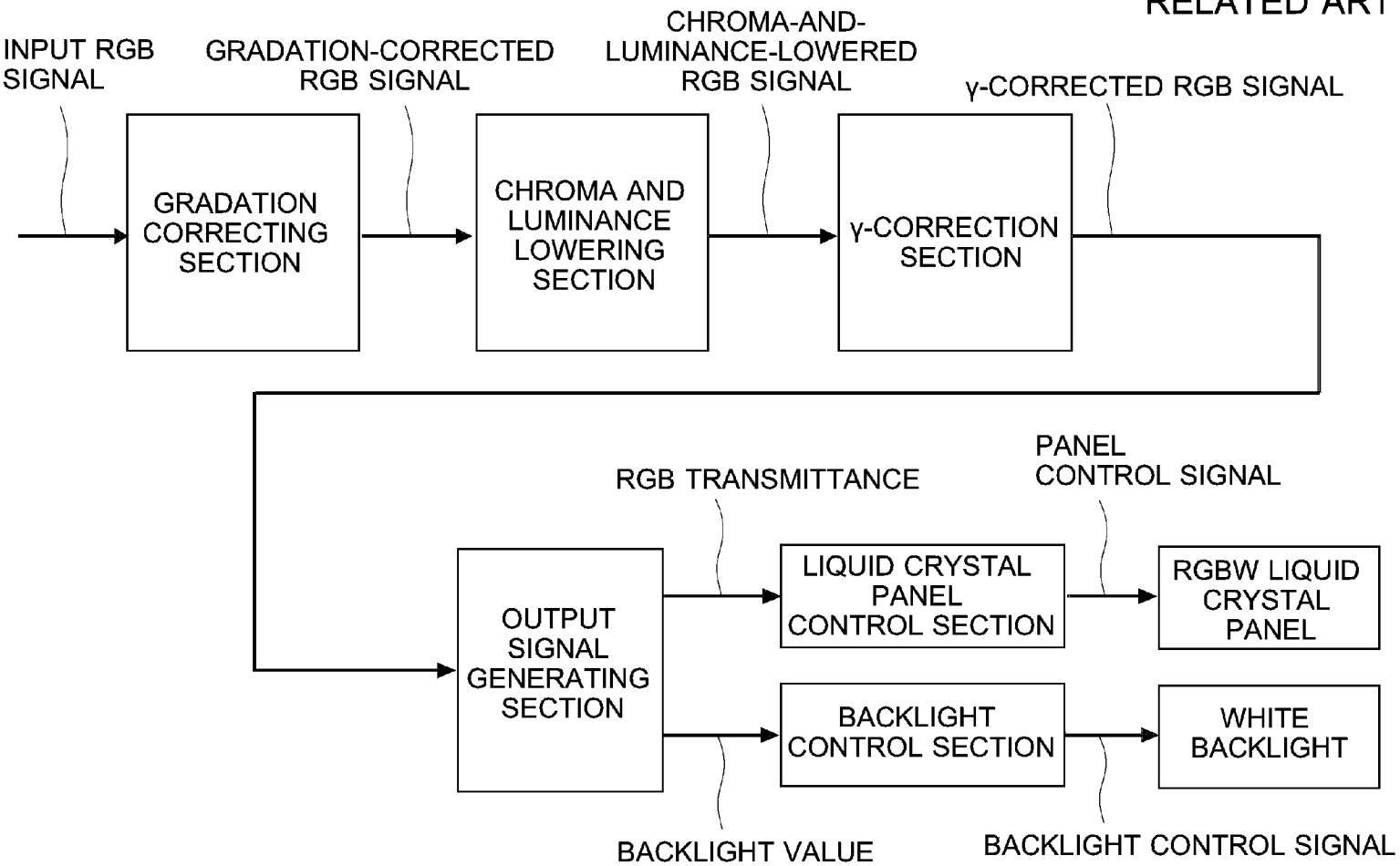
FIG. 15 RELATED ART
FIG. 15 is a representative diagram of the other conventional art.

Next, a control circuit relating to Example 3 and a display device equipped with the control circuit will be described with reference to FIG. 11. FIG. 11 is a block diagram illustrating a structural example of a W value redistributing circuit section in which an availability of the W value redistributing circuit section can be set.

Example 3 employs a structure which can set an availability of the W value redistributing circuit section 68 (that is, image signal processing circuit 60 is equipped with a section to turn the W value redistributing circuit section 68 to ON or OFF). Under the condition that the display panel has a characteristic that the white chromaticity depends on gradation values, redistributing circuit availability setting section 68*g* illustrated in FIG. 11 makes W value redistributing circuit section 68 available (in other words, uses the calculation result of output signal (RGBW) calculating section 68*d*). Under another condition that the display panel has a characteristic that the white chromaticity does not change with respective to gradation values, redistributing circuit availability setting section 68*g* illustrated in FIG. 11 makes W value redistributing circuit section 68 unavailable (in other words, uses the calculation result of pixel (RGBW) luminance reducing circuit section 63) to stop the corresponding part of the circuit, because it is unnecessary that the W value redistributing circuit section 68 works. Therefore, electricity to be consumed by the stopped part can be saved.

As described above, by providing a section to set the availability of W value redistributing circuit section 68, the control circuit can drive a display panel efficiently in both cases that the white chromaticity of the display panel depends on gradation values and that that is constant with respect to gradation values. The setting operation of the availability of the W value redistributing circuit section 68 may be conducted by an external ROM or a setting resistor. Further, other processing of the control other than the setting operation of the availability of the W value redistributing circuit section 68 is the same as the descriptions of Example 1.

Here, the present invention should not be limited to the above-mentioned embodiments and examples, and the constitution and the control method of image signal processing circuit 60 (especially, W value redistributing circuit section 68) may be modified appropriately unless the modification deviates from the intention of the present invention.

The invention claimed is:

1. A control circuit which conducts a drive control of a RGBW display panel to operate white pixels to light up together with red pixels, green pixels and blue pixels, the drive control including a luminance control of a backlight to reduce luminance of the backlight according to an amount of an increase in luminance of the RGBW display panel due to a lighting operation of the white pixels, the control circuit comprising:

a first circuit section configured to generate control signals to be used for controlling the RGBW display panel, based on input image signals; and a second circuit section configured to generate control signals to be used for controlling the backlight, based on the input image signals, wherein the first circuit section includes a redistributing circuit section configured to conduct luminance-redistribution processing under a condition that the RGBW display panel has a characteristic that a chromaticity of white displayed thereon depends on gradation values, where the luminance-redistribution processing includes distributing a luminance component of each of the white pixels to corresponding the red, green and blue pixels and reducing luminance of the each of the white pixels, and wherein the redistributing circuit section is configured to conduct the luminance-redistribution processing so as to make a chromaticity variation ($\Delta x2$, $\Delta y2$) always smaller than a chromaticity variation ($\Delta x1$, $\Delta y1$), where the chromaticity variation ($\Delta x1$, $\Delta y1$) is obtained from the characteristic of the RGBW display panel, and is a variation of a chromaticity of a screen in middle tone color displayed on the RGBW display panel with respect to a chromaticity of an all-white screen displayed on the RGBW display panel, the chromaticity of the screen in middle tone color being displayed on the RGBW display panel when middle tone color signals are inputted to the control circuit as the input image signals, the chromaticity of the all-white screen being displayed on the RGBW display panel when signals of the all-white screen are inputted to the control circuit as the input image signals, and when the screen in middle tone color is displayed on the RGBW display panel, gradation values of the red, green and blue pixels are the same to each other and luminance of the screen in middle tone color is reduced by half of luminance of the all-white screen, and where the chromaticity variation ($\Delta x2$, $\Delta y2$) is a variation of a chromaticity of a white area of a screen in two colors displayed on the RGBW display panel with respect to the chromaticity of the all-white screen displayed on the RGBW display panel, under a condition that the control circuit controls the RGBW display panel with conducting the luminance control of the backlight, the screen in two colors being prepared by replacing half of the all-white screen with a primary-color area in one of red, green and blue.

2. A control circuit which conducts a drive control of a RGBW display panel to operate white pixels to light up together with red pixels, green pixels and blue pixels, the drive control including a luminance control of a backlight to reduce luminance of the backlight according to an amount of an increase in luminance of the RGBW display panel due to a lighting operation of the white pixels, the control circuit comprising:

a first circuit section configured to generate control signals to be used for controlling the RGBW display panel, based on input image signals; and a second circuit section configured to generate control signals to be used for controlling the backlight, based on the input image signals, wherein the first circuit section includes a redistributing circuit section configured to conduct luminance-redistribution processing under a condition that the RGBW display panel has a characteristic that a chromaticity of white displayed thereon depends on gradation values, where the luminance-redistribution processing includes distributing a luminance component of each of the white pixels to corresponding the red, green and blue pixels and reducing luminance of the each of the white pixels, wherein the redistributing circuit section is configured to, for operating each of the white pixels to light up, distribute the luminance component of the each of the white pixels to the corresponding red, green and blue pixels so as to make a maximum value among luminance components of the corresponding red, green and blue pixels equal to a maximum value among possible luminance values which can be displayed on the RGBW display panel, and wherein the redistributing circuit section is configured to calculate output signals Rw, Gw, Bw and Ww of the red, green, blue and white pixels by the following formulas, where Rout, Gout, Bout and Wout denote the luminance components of the red, green, blue and white pixels, MAXrgb denotes the maximum value among the luminance components of the corresponding red, green and blue pixels, f(n) denotes the maximum value among the possible luminance values which can be displayed on the RGBW display panel, and W_coef is given as W_coef=f(n)−MAXrgb:

for $Wout \leq W_coef$, $Rw = Rout + Wout$, $Gw = Gout + Wout$, $Bw = Bout + Wout$, and $Ww = 0$; and for $Wout > W_coef$, $Rw = Rout + W_coef$, $Gw = Gout + W_coef$, $Bw = Bout + W_coef$, and $Ww = Wout - W_coef$, convert the output signals Rw, Gw, Bw and Ww into gradation signals, and output the gradation signals to a driver to drive the RGBW display panel.

3. The control circuit of claim 2, further comprising a switch section which turns the redistributing circuit section ON or OFF, the switch section being configured to, on turning the redistributing circuit section to OFF, assign the luminance components Rout, Gout, Bout and Wout to the output signals Rw, Gw, Bw and Ww, convert the output signals Rw, Gw, Bw and Ww into gradation signals, and output the gradation signals to the driver to drive the RGBW display panel.

4. A control circuit which conducts a drive control of a RGBW display panel to operate white pixels to light up together with red pixels, green pixels and blue pixels, the drive control including a luminance control of a backlight to reduce luminance of the backlight according to an amount of an increase in luminance of the RGBW display panel due to a lighting operation of the white pixels, the control circuit comprising:

a first circuit section configured to generate control signals to be used for controlling the RGBW display panel, based on input image signals; and a second circuit section configured to generate control signals to be used for controlling the backlight, based on the input image signals, wherein the first circuit section includes a redistributing circuit section configured to conduct luminance-redistribution processing under a condition that the RGBW display panel has a characteristic that a chromaticity of white displayed thereon depends on gradation values, where the luminance-redistribution processing includes distributing a luminance component of each of the white pixels to corresponding the red, green and blue pixels and reducing luminance of the each of the white pixels, and wherein the redistributing circuit section is configured to calculate output signals Rw, Gw, Bw and Ww of the red, green, blue and white pixels by the following formulas, where Rout, Gout, Bout and Wout denote luminance components of the red, green, blue and white pixels, MAXrgb denotes a maximum value among the luminance components of the corresponding red, green and blue pixels, f(n) denotes a maximum value among possible luminance values which can be displayed on the RGBW display panel, W_coef is given as W_coef=f(n)−MAXrgb, $\alpha$ is a real number satisfying $0<\alpha<1$ and $\beta$ is a real number satisfying $0<\beta<1$:

for $Wout \leq W_coef$, $Rw = Rout + (Wout \times \alpha)$, $Gw = Gout + (Wout \times \alpha)$, $Bw = Bout + (Wout \times \alpha)$, and $Ww = Wout \times (1-\alpha)$; and for $Wout > W_coef$, $Rw = Rout + (W_coef \times \beta)$, $Gw = Gout + (W_coef \times \beta)$, $Bw = Bout + (W_coef \times \beta)$, and $Ww = Wout - (W_coef \times \beta)$, convert the output signals Rw, Gw, Bw and Ww into gradation signals, and output the gradation signals to a driver to drive the RGBW display panel.

5. The control circuit of claim 4, wherein the redistributing circuit section is configured to set $\alpha$ and $\beta$ to a value in a range of $0.5 \leq \alpha < 1$ and a value in a range of $0.5 \leq \beta < 1$, respectively.

6. The control circuit of claim 4, further comprising a switch section which turns the redistributing circuit section ON or OFF, the switch section being configured to, on turning the redistributing circuit section to OFF, assign the luminance components Rout, Gout, Bout and Wout to the output signals Rw, Gw, Bw and Ww, convert the output signals Rw, Gw, Bw and Ww into gradation signals, and output the gradation signals to the driver to drive the RGBW display panel.

7. A control circuit which conducts a drive control of a RGBW display panel to operate white pixels to light up together with red pixels, green pixels and blue pixels, the drive control including a luminance control of a backlight to reduce luminance of the backlight according to an amount of an increase in luminance of the RGBW display panel due to a lighting operation of the white pixels, the control circuit comprising:

a first circuit section configured to generate control signals to be used for controlling the RGBW display panel, based on input image signals; and a second circuit section configured to generate control signals to be used for controlling the backlight, based on the input image signals, wherein the first circuit section includes a redistributing circuit section configured to conduct luminance-redistribution processing under a condition that the RGBW display panel has a characteristic that a chromaticity of white displayed thereon depends on gradation values, where the luminance-redistribution processing includes distributing a luminance component of each of the white pixels to corresponding the red, green and blue pixels and reducing luminance of the each of the white pixels, wherein the redistributing circuit section is configured to, for operating each of the white pixels to light up, distribute the luminance component of the each of the white pixels to the corresponding red, green and blue pixels so as to make a maximum value among luminance components of the corresponding red, green and blue pixels equal to a maximum value among possible luminance values which can be displayed on the RGBW display panel, and wherein the redistributing circuit section is configured to calculate output signals Rw, Gw, Bw and Ww of the red, green, blue and white pixels by the following formulas, where Rout, Gout, Bout and Wout denote the luminance components of the red, green, blue and white pixels, MAXrgb denotes the maximum value among the luminance components of the corresponding red, green and blue pixels, f(n) denotes the maximum value among the possible luminance values which can be displayed on the RGBW display panel, W_coef is given as W_coef=f(n)−MAXrgb, a ratio of a maximum luminance component of white which can be created by the each of the white pixels to a maximum luminance component of white which can be created by the corresponding red, green and blue pixels is q to p, and each of q and p is a real number:

for $(q/p)\times Wout \leq W_coef$, $Rw=Rout+(q/p)\times Wout$, $Gw=Gout+(q/p)\times Wout$, $Bw=Bout+(q/p)\times Wout$, and $Ww=0$; and for $(q/p)\times Wout > W_coef$, $Rw=Rout+W_coef$, $Gw=Gout+W_coef$, $Bw=Bout+W_coef$, and $Ww=(p/q)\times((q/p)\times Wout-W_coef)$, convert the output signals Rw, Gw, Bw and Ww into gradation signals, and output the gradation signals to a driver to drive the RGBW display panel.

8. The control circuit of claim 7, further comprising a switch section which turns the redistributing circuit section ON or OFF, the switch section being configured to, on turning the redistributing circuit section to OFF, assign the luminance components Rout, Gout, Bout and Wout to the output signals Rw, Gw, Bw and Ww, convert the output signals Rw, Gw, Bw and Ww into gradation signals, and output the gradation signals to the driver to drive the RGBW display panel.

9. A control circuit which conducts a drive control of a RGBW display panel to operate white pixels to light up together with red pixels, green pixels and blue pixels, the drive control including a luminance control of a backlight to reduce luminance of the backlight according to an amount of an increase in luminance of the RGBW display panel due to a lighting operation of the white pixels, the control circuit comprising:

a first circuit section configured to generate control signals to be used for controlling the RGBW display panel, based on input image signals; and a second circuit section configured to generate control signals to be used for controlling the backlight, based on the input image signals, wherein the first circuit section includes a redistributing circuit section configured to conduct luminance-redistribution processing under a condition that the RGBW display panel has a characteristic that a chromaticity of white displayed thereon depends on gradation values, where the luminance-redistribution processing includes distributing a luminance component of each of the white pixels to corresponding the red, green and blue pixels and reducing luminance of the each of the white pixels, and wherein the redistributing circuit section is configured to calculate output signals Rw, Gw, Bw and Ww of the red, green, blue and white pixels by the following formulas, where Rout, Gout, Bout and Wout denote luminance components of the red, green, blue and white pixels, MAXrgb denotes a maximum value among luminance components of the corresponding red, green and blue pixels, f(n) denotes a maximum value among possible luminance values which can be displayed on the RGBW display panel, W_coef is given as W_coef=f(n)−MAXrgb, a ratio of a maximum luminance component of white which can be created by the each of the white pixels to a maximum luminance component of white which can be created by the corresponding red, green and blue pixels is q to p, each of q and p is a real number, α is a real number satisfying $0<\alpha<1$ and β is a real number satisfying $0<\beta<1$:

for $(q/p)\times Wout \leq W_coef$, $Rw=Rout+(q/p)\times(Wout\times\alpha)$, $Gw=Gout+(q/p)\times(Wout\times\alpha)$, $Bw=Bout+(q/p)\times(Wout\times\alpha)$, and $Ww=(q/p)\times Wout\times(1-\alpha)$; and for $(q/p)\times Wout > W_coef$, $Rw=Rout+(W_coef\times\beta)$, $Gw=Gout+(W_coef\times\beta)$, $Bw=Bout+(W_coef\times\beta)$, and $Ww=(p/q)\times((q/p)\times Wout-(W_coef\times\beta))$, convert the output signals Rw, Gw, Bw and Ww into gradation signals, and output the gradation signals to a driver to drive the RGBW display panel.

10. The control circuit of claim 9, further comprising a switch section which turns the redistributing circuit section ON or OFF, the switch section being configured to, on turning the redistributing circuit section to OFF, assign the luminance components Rout, Gout, Bout and Wout to the output signals Rw, Gw, Bw and Ww, convert the output signals Rw, Gw, Bw and Ww into gradation signals, and output the gradation signals to the driver to drive the RGBW display panel.

11. A display device comprising:

a backlight;

a RGBW display panel having a characteristic that a chromaticity of white displayed thereon depends on gradation values, and comprising a plurality of unit pixels each including red, green, blue and white pixels; and the control circuit of claim 1, configured to conduct a drive control of the RGBW display panel to operate the white pixels to light up together with the red pixels, green pixels and blue pixels, the drive control including a luminance control of the backlight to reduce luminance of the backlight according to an amount of an increase in luminance of the RGBW display panel due to a lighting operation of the white pixels.

* * * * *